US010663146B2

(12) United States Patent
Stevenson et al.

(10) Patent No.: US 10,663,146 B2
(45) Date of Patent: May 26, 2020

(54) FLASHLIGHTS AND METHODS OF USE

(71) Applicants: Chad William Stevenson, Conroe, TX (US); Bobby John Housos, Conroe, TX (US); Kyle Kenneth Fabian, Conroe, TX (US)

(72) Inventors: Chad William Stevenson, Conroe, TX (US); Bobby John Housos, Conroe, TX (US); Kyle Kenneth Fabian, Conroe, TX (US)

( * ) Notice: Subject to any disclaimer, the term of this patent is extended or adjusted under 35 U.S.C. 154(b) by 0 days.

(21) Appl. No.: 16/588,602

(22) Filed: Sep. 30, 2019

(65) Prior Publication Data

US 2020/0103094 A1 Apr. 2, 2020

Related U.S. Application Data

(60) Provisional application No. 62/766,075, filed on Sep. 29, 2018.

(51) Int. Cl.

| | |
|---|---|
| ***F21V 9/08*** | (2018.01) |
| ***F21V 19/00*** | (2006.01) |
| ***F21V 14/02*** | (2006.01) |
| ***F21L 4/02*** | (2006.01) |

(52) U.S. Cl.

CPC ..... *F21V 9/083* (2013.01); *F21L 4/027* (2013.01); *F21V 14/025* (2013.01); *F21V 19/001* (2013.01)

(58) Field of Classification Search

None

See application file for complete search history.

(56) References Cited

U.S. PATENT DOCUMENTS

| | | | | |
|---|---|---|---|---|
| 7,534,975 | B1 * | 5/2009 | Sharrah | F21V 23/0428 200/600 |
| 9,951,928 | B2 | 2/2018 | Jones | |
| 10,208,924 | B2 | 2/2019 | Jones | |
| 2005/0088843 | A1 * | 4/2005 | Chapman | F21L 4/027 362/184 |

* cited by examiner

*Primary Examiner* — Britt D Hanley

(74) *Attorney, Agent, or Firm* — Kearney, McWilliams & Davis, PLLC; William C. Yarbrough

(57) ABSTRACT

The present invention relates to a flashlight capable of generating and projecting multiple colors within one flashlight unit where said flashlight contains an extendable lens, a light source, a moveable member positionable at various locations to be moved across said light source, a rechargeable power source and a tail cap switch for 'on' and 'off' functions as well as dimming and brightening of a light source beam. The moveable member is slidably fixed to move perpendicular to a light source whereby movement to designated positions allows communication displaying different color light sources is positioned between a power source and a flashlight lens whereby a releasably-urging spring and rotatable, keyed cam ring serve to compress and release said spring to allow for color change.

24 Claims, 24 Drawing Sheets

FLASHLIGHTS AND METHODS OF USE

CROSS-REFERENCE TO RELATED APPLICATIONS

This is a continuation-in-part of U.S. application Ser. No. 29/651,540 filed Aug. 22, 2018, entitled "Flashlight," and naming as applicants Chad William Stevenson, Bobby John Housos and Kyle Kenneth Fabian.

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND

1. Field of the Invention

The present invention relates generally to flashlights and specifically to flashlights having interchangeable, multiple color light sources within one color beam modifiable flashlight in combination with adjustable beam intensity, variable beam distance and beam width adjustability.

2. Description of Some Related Art

In 1898 Conrad Hubert invented the first serviceable flashlight including a metal tube encompassing a light bulb and a battery. And while there have been numerous changes to Hubert's original design, flashlights themselves have been little changed in terms of light production and components (e.g. a cylindrical case, light source, reflector, battery and a switch). Flashlight technology today, though, does include flashlights with LED light sources and flashlights with a lamp or bulb adjustability, typically located at a focal point of a parabolic reflector and located inferior to a focusing lens, that are capable of interchangeable focal points, individually interchangeable, multi-light color production as well as various beam light intensities (including steady to intermittent beam production). Too, contemporary flashlights have been made to harbor power sources that are extendable, through advancements in battery life potentiation and rechargeability, that far exceeds any flashlight even imagined in 1898.

Yet current flashlights exhibit a variety of deficiencies and problems including: non-uniform intensity, masking of features of an object, requiring a relatively long time to adjust beam focal length, excessive battery drainage of a flashlight inadvertently left on, ineffective adjusting and/or setting of beam light brightness, requirements for additional LED structures or modules to be physically changed if additional beam colors are desired and, in some cases, the necessity of removing batteries for charging or replacement without an alternate power source.

It is inventors' intention to address the infirmities in the prior art above and to address the unmet, long-felt needs in offering a flashlight capable of operating in self-contained, multi-light configurations that are modifiable in terms of beam width, distance and intensity as well as various (self-contained) color variations (up to and including infrared, the visible spectrum and ultraviolet wavelengths). The present invention satisfies this long-standing need in the art.

SUMMARY OF THE INVENTION

The present invention, in certain and not necessarily all aspects and features, discloses a new and novel flashlight that includes a body with an internalized battery or batteries, one to multiple light sources (which may be lamp(s), bulb(s), or an LED light or lights), optionally, internalized color selection of different color light sources and/or light types, beam focus modification, beam width adjustment and beam intensity adjustment.

In certain embodiments, but in not necessarily all aspects, such flashlights have a selective color subsystem for easily, quickly, and efficiently switching and fixedly securing the color of the flashlight's output beams. In certain aspects, this innovative switching system includes an multi-level, inner surface cam ring whose internalized camming surface has a plurality of grooved and spaced cam areas, at increasing depths (heights), into which a linearly movable cam member acts as a cam follower, moving perpendicular to the centrally running axis of both the cam ring and flashlight body, advanced by manual induction wherein turning the cam ring translocates a movable member (i.e. reciprocating and translating cam follower) against an opposing spring into one of several positions made to express one of a number of a light sources. The cam ring and cam follower is best viewed as an "inverted" or reverse 'knife-edge cam and follower' whereby, as opposed to a traditional 'knife-edge cam and cam follower', the translating (and translocating) cam consists of a series of internalized ridges of ever increasing heights/depths operating to induce linear translocation of a reciprocating cam follower inward (and outward) toward (and away) from the cam's axial center and centrally deposed light generating source. The reciprocating cam follower is best viewed as a bullet shaped carrier having longitudinal insets for linear placement of lighting elements. Each forwardly deposed lighting element is made to communicate rearwardly with a conductive element that is oriented to receive power from a power source (e.g. battery) for actuation and illumination. The cam ring surfaces are configured and designed so that a releasably-urging member (e.g. but not limited to an appropriate spring or springs) effectively holds a tip of the cam follower within a certain cam area (corresponding to a depth conforming to a certain chosen light source of a desired color) so that the follower is releasably held in a position by the spring force until, via application of sufficient force, it is forcibly moved to a next cam area via cam ring rotation to overcome the semi-stationary configuration. The cam follower tip is configured to seat a ball bearing thereby reducing friction due to wear of the cam follower point along the cam ring's inner surface. The spring-induced force may again be overcome to move into a next cam area (either forward or backwards) to advance the cam follower to select a new light color by clockwise, or counterclockwise rotation, to the immediately succeeding, or immediately preceding, cam area wherein clockwise and counterclockwise rotations allow for the selection of corresponding light selection(s). Additionally, the cam ring includes an inner keyed surface area in conjunction with a flashlight keyed portion for movement only within a predetermined and designated area and for disposition adjacent a portion of the key surface by a keyed inner surface to such an extent that the keyed portion can move along the key surface, but cannot move out of or beyond the keyed surface, thereby preventing the cam ring from extending beyond its dedicated path.

In certain aspects, a flashlight according to the present invention is sized, shaped and configured so that it has a front end, a middle, and a rear end, with the flashlight middle sized to be less in diameter than the two ends and long enough to accommodate the width of an average person's hand thereby inhibiting inadvertent dropping of the flashlight and to facilitate easy handling and manipulation of the flashlight. In one aspect the front end of the flashlight is made large enough that the typical person's hands cannot overlap fingers when holding said flashlight.

In some embodiments of the present invention, an electronic device or devices (with, e.g. appropriate circuits, boards, chips, wiring, connections, lines, cables, etc.) are provided so that the flashlight is turned on by, and only by, holding a switch on or pushing a pin, or by pushing in or turning a plug, for a certain time period, e.g. 2, 3, 4, 5, 6, 7, 8, 9, 10, seconds or more. This required time period can be a safety feature that prevents the flashlight from inadvertently being turned on, for example, when the flashlight is in a bag, backpack, case, or container, thus ensuring that the flashlight battery is not unintentionally drained. Optionally, the flashlight can be turned on in a more expedited manner where activation occurs immediately with either a minor delay or no pre-set delay. Optionally, the flashlight can be pre-set, using the electronic device(s) for activation and deactivation. Optionally, the flashlight may include an apparatus for emitting a desired sound, alert, signal, vibration, or warning, for example, but not limited to, when the battery is almost drained, when the flashlight is activated, when the flashlight is dormant for a pre-set desired time period and/or when the flashlight receives a signal from another device or apparatus signifying a change in flashlight status.

In certain aspects, at least a portion of the flashlight's body is sized, shaped and configured so that it is easily attachable or connectable to another item such as a gun, gun scope, rifle, pistol, cap, hat, helmet, hard hat, tool, medical or veterinary instrument or device, surgical apparatus or instrument, support, and/or a vehicle. It is well within the scope and intent of inventors, though, to attach the present invention to any other device capable of accommodating said invention.

In certain, but not necessarily all, aspects, the present invention provides a combination of a flashlight and another item. This other item can include, for example, and not by way of limitation, a knife, a bayonet or an ONM emitter ("ONM" is olfactory nullifying material). In one particular aspect, the ONM is ozone and the item is an "ozonator" which is sized and positioned so that ozone is emitted from an opening or nozzle forward of a forwardmost edge of the flashlight. Optionally, ONM can be emitted from the rear of a flashlight according to the present invention. In certain aspects, an "ozonator" is provided within or on the flashlight.

In certain aspects, but not necessarily all, the present invention provides a flashlight that has design, artwork, or a logo on, etched in, or embedded in a surface of a reflector, a surface of part of a body or housing, the surface being visible while the flashlight is being held or is in use, for example, but not limited to, a reflector surface behind a lens, and/or a surface of a lens. This can be, without limitation, a trademark, a personalized image, letter(s), symbol(s), number(s), identifying indicia, or any other suitable desired marking(s).

Accordingly, the present invention includes features and advantages which are believed to advance flashlight technology. Characteristics and advantages of the present invention described herein and additional features and benefits will become known to and appreciated by those skilled in the art who have and value the benefit of the new and nonobvious teachings of the present invention, upon consideration of the following detailed description of certain embodiments and referring to the accompanying drawings.

Certain embodiments of this invention are not limited to any particular individual feature or aspects disclosed herein but include combinations of them distinguished from the prior art in their structures, functions, designs, configurations, methods of use, and/or functionality. Features and aspects of the invention have been broadly described so that the detailed descriptions that follow may be better understood, and in order that the contributions of this invention to the arts and to the technology may be better appreciated. It is to be understood that any individual design feature or features, aspect or aspects, element or elements or part or two or more parts thereof shown in any drawing figure hereof that may, as desired, be incorporated into any other embodiment or design disclosed herein.

Those skilled in the art, after they have and appreciate the benefits of this invention, its teachings, and suggestions, may come to know and realize that the conceptions of this disclosure may be used as a creative basis for designing other structures, methods, processes, and systems for carrying out and practicing the present invention. The claims of this invention are to be read to include any legally equivalent structures, systems, devices or methods which do not depart from the spirit and scope of the present invention.

One of skill in this art, after she or he has the benefits of this invention's realizations, teachings, disclosures, and suggestions, other purposes and advantages, which will become known from the following description of certain embodiments, given for the purpose of disclosure, when taken in conjunction with the accompanying drawings, will have the ability to appreciate the novelty of the present invention. The detail in these descriptions, though, is not intended to thwart this inventor's object to claim this invention's innovative features, no matter how others may later augment or modify it by variations in form, changes, or additions of further improvements.

It is understood that the various embodiments of the present invention may include one, some, or any possible combination of the disclosed, described, and/or enumerated features, aspects, elements, parts, and/or improvements and/or technical advantages in the claims to this invention.

As used herein, the term "and/or" includes any and all combinations of one or more of the associated listed items. Spatially relative terms, such as "below," "lower," "upper" and the like, can be used herein for ease of description to describe one element or features relationship to another element(s) or feature(s) as illustrated.

BRIEF DESCRIPTION OF THE SEVERAL VIEWS OF THE DRAWINGS

A more particular description of certain, but not all, embodiments of the invention briefly summarized above may be had by references to the embodiments which are shown in the drawings which form a part of this specification.

These drawings illustrate embodiments envisaged at the time of filing for this patent and are not to be used to improperly limit the scope of the invention which may have other equally effective or legally equivalent embodiments.

Figure 1:
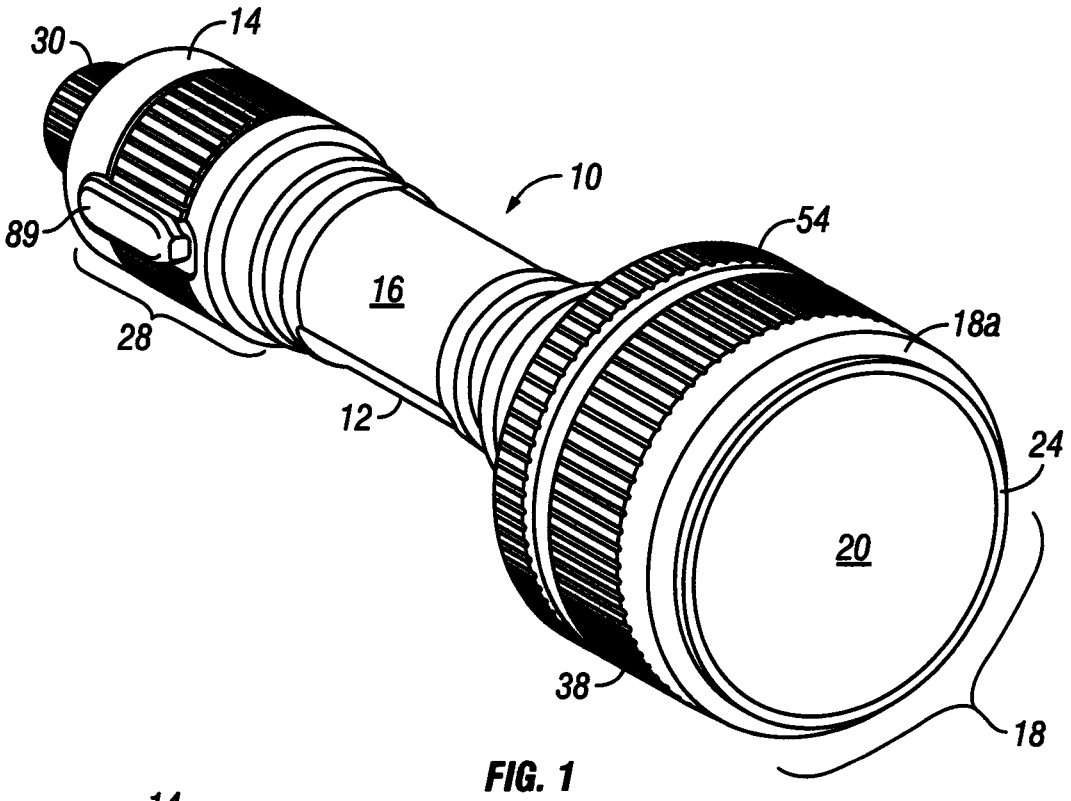
FIG. 1 presents a front perspective view of a flashlight according to the present invention.

Certain embodiments of the invention are shown in the above-identified figures and described in detail below. Various aspects and features of embodiments of the invention are described below. Any combination of aspects and/or features described below can be used except where such aspects and/or features are mutually exclusive, functionally self-defeating, or contradictory.

It should be understood that the appended drawings and description herein are of certain embodiments and are not intended to limit the invention. On the contrary, the intention is to cover all modifications, equivalents and alternatives falling within the spirit and scope of the invention as defined by the appended claims.

In showing and describing these embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiments and are not intended to mean the claimed invention of any particular embodiment. Accordingly, the subject or topic of each such reference is not automatically or necessarily part of, or required by, any particular embodiment. So long as they are not mutually exclusive or contradictory any aspect or feature or combination of aspects or features of any embodiment disclosed herein may be used in any other embodiment disclosed herein. The present invention includes a variety of aspects, which may be combined in different ways.

The following descriptions are provided to list elements and describe some of the embodiments of the present invention. These elements are listed with initial embodiments, however it should be understood that they may be combined in any manner and in any number to create additional embodiments. The variously described examples and embodiments should not be construed to limit the present invention to only the explicitly described systems, techniques, methods and applications.

Although there may be a description of operation(s) as a sequential process, many of the operation(s) can be performed in parallel or concurrently. In addition, the order of the operations may be rearranged. Order may be rearranged to accommodate specific processes, product forms, or performance requirements. A process may be terminated when its operations are completed but could have additional steps not discussed or included in a figure. Furthermore, not all operations or steps in any particularly described method or process may occur in all embodiments.

DESCRIPTION OF CERTAIN NON-LIMITING EMBODIMENTS

Knowing not all embodiments exhibiting all permutations may be disclosed, the specific embodiments shown in the drawing figures and described below are exemplary and are not all the embodiments of the present invention described, claimed and disclosed herein. Inventors have, however, set forth the best mode contemplated by inventors as being the best representation of the invention as shown and described.

Figure 2:
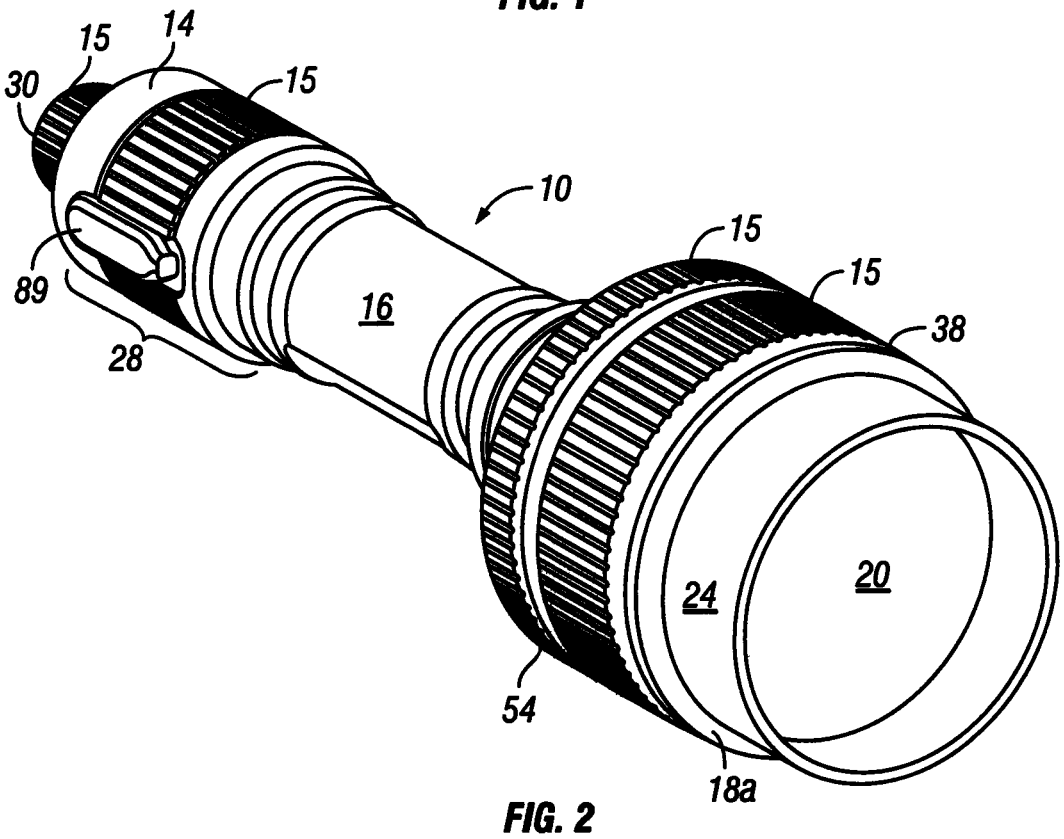
FIG. 2 is a view of the flashlight of FIG. 1 with part of a lens assembly extended.
Figure 14A:
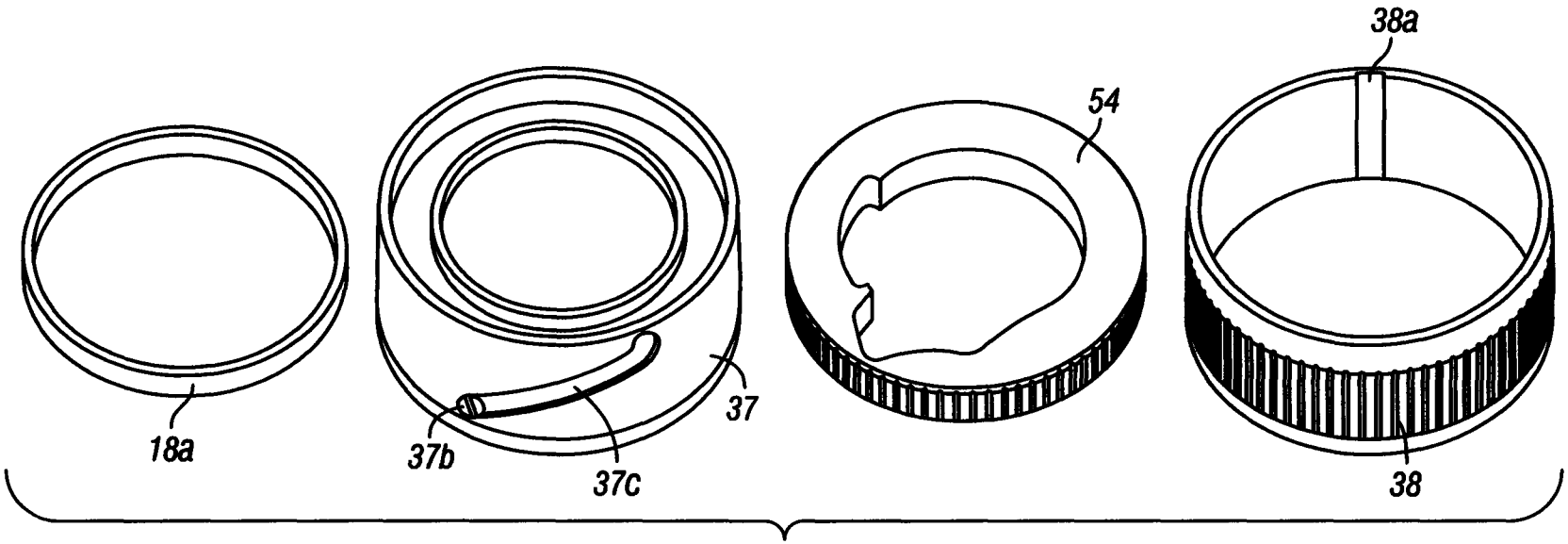
FIG. 14*a* shows perspective views of font end ring, an internalized lens projection ring, a cam ring and an external lens ring, from left to right.
Figure 14B:
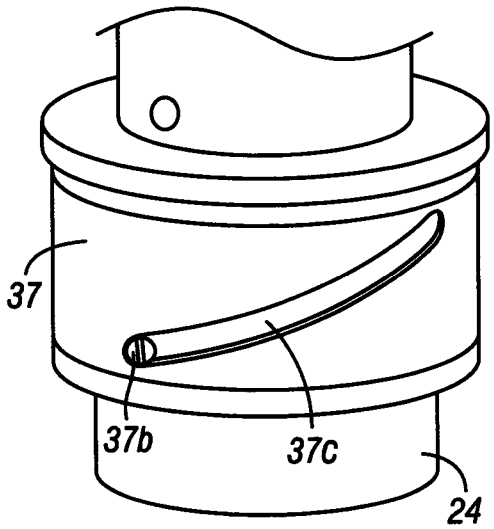
FIG. 14*b* illustrates an internalized lens projection ring with extended lens.
Figure 14C:
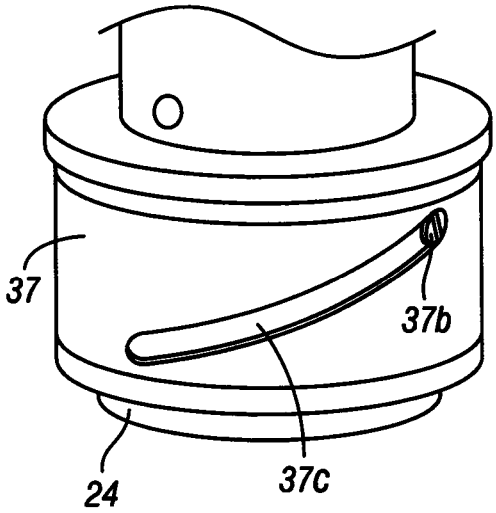
FIG. 14*c* depicts an internalized lens projection ring with retracted lens.
Figure 15:
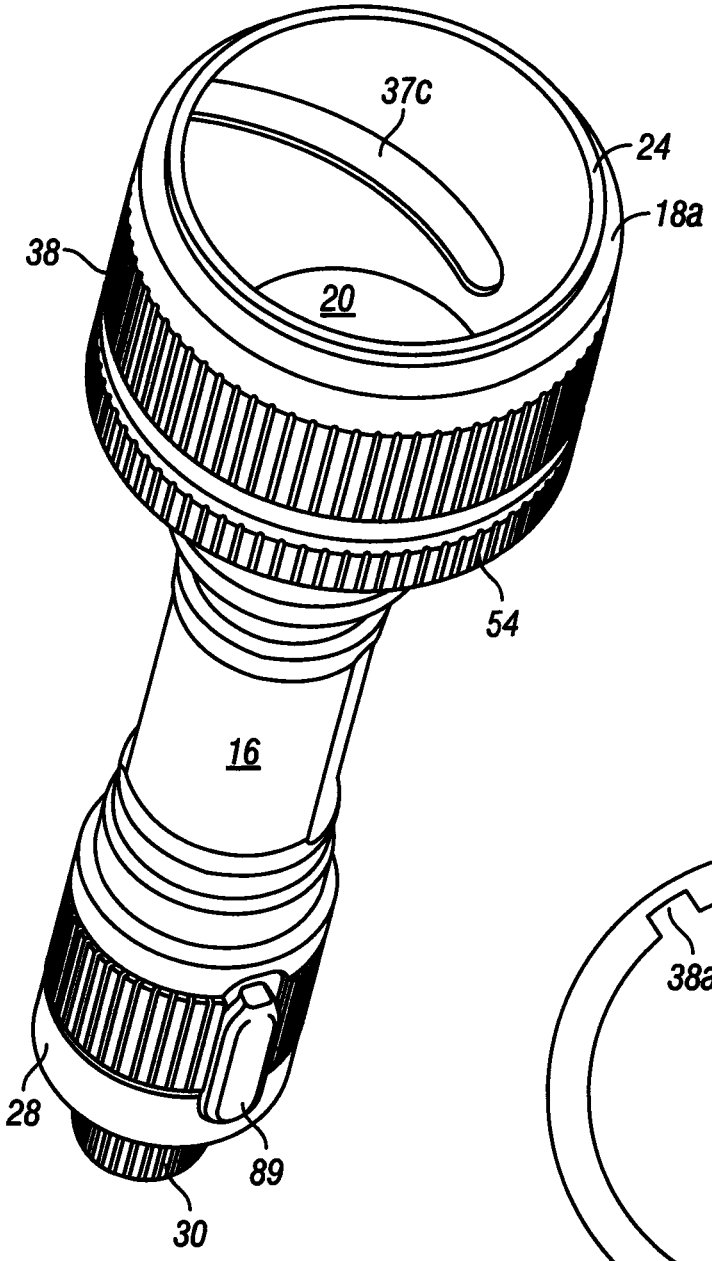
FIG. 15 is a perspective view of part of the body of the flashlight of FIG. 1 lens ring with a channel which accommodates movement of the lens toward and away from light source(s).
Figure 16:
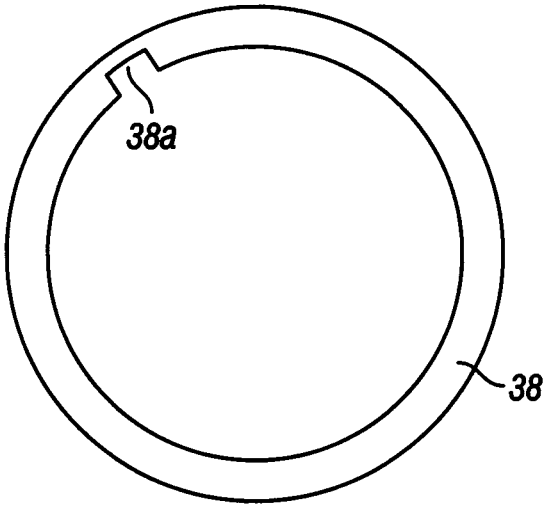
FIG. 16 is a cross sectional view of a lens adjustment ring and its accommodating groove which receives and holds a head of a screw that is connected to the internalized lens projection ring.
Figure 17:
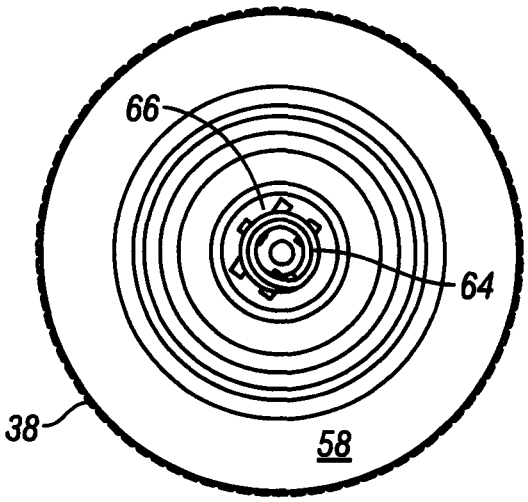
FIG. 17 is an end view showing a circuit board and spring, without flashlight middle attached.
Figure 18:
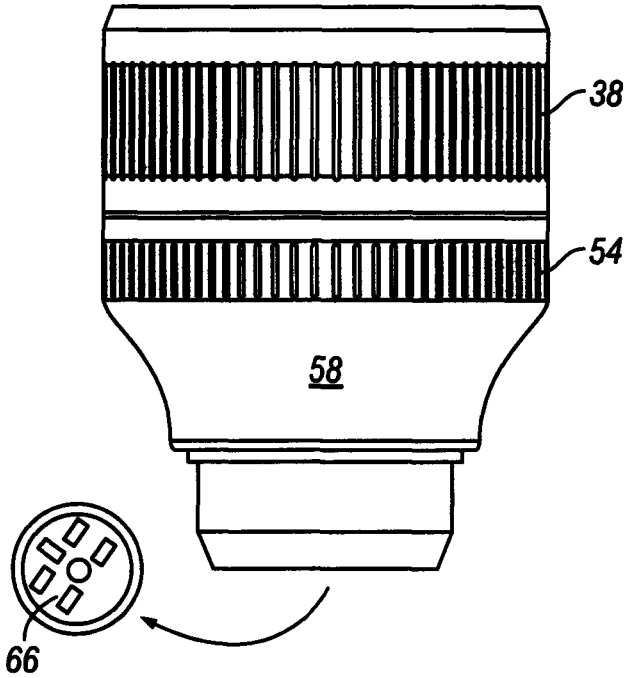
FIG. 18 shows the circuit board of FIG. 17 removed from the flashlight.
Figure 19:
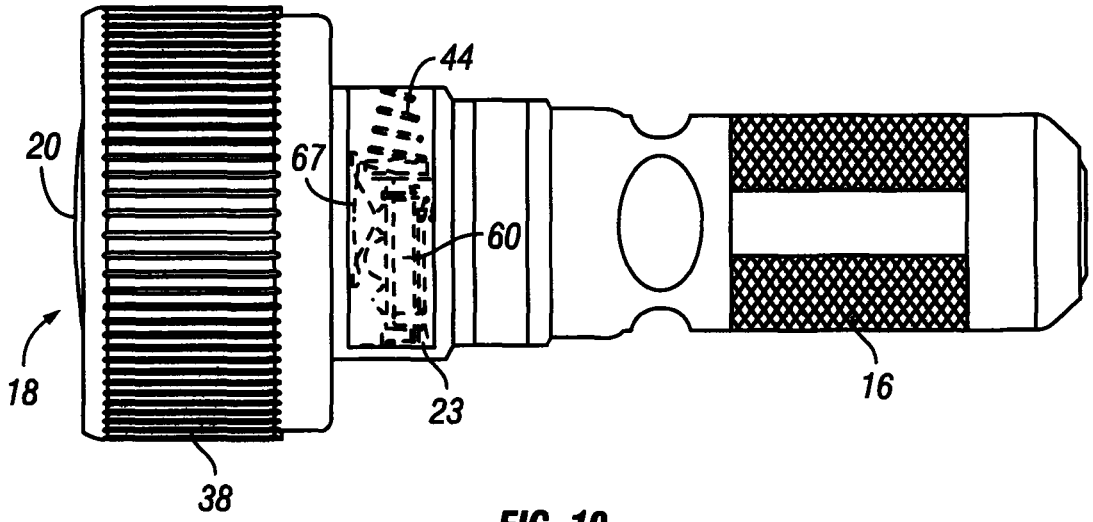
FIG. 19 is a side view of the flashlight of FIG. 1 representing an internalized cam follower, light source and opposing spring.
Figure 20:
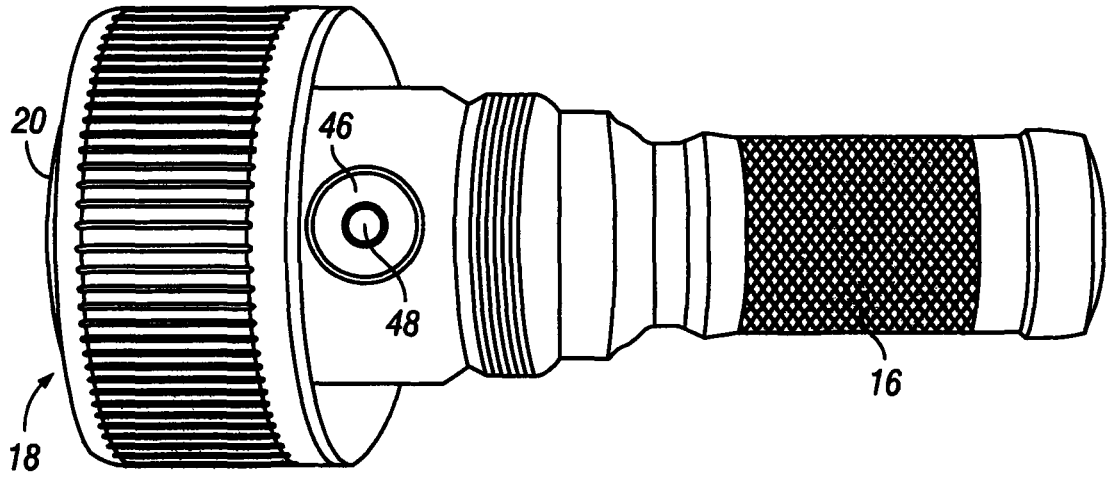
FIG. 20 is a side view of the flashlight as shown in FIG. 19 rotated 90 degrees and looking down on a cam follower tip of the cam follower.

FIG. 1-23 show a flashlight 10 together with several depictions of internal operable mechanisms according to the present invention. According to FIG. 1 the flashlight 10 has (1) a body 12 with (2) a rear end 14, (3) a middle end 16 and (4) a front end 18. The flashlight 10 has a means used to adjust a beam of light from the flashlight 10 by the manual rotational movement (as well as an extension and retraction as depicted in FIGS. 1 and 2) of a lens 20 toward and away from a light system 60 (FIG. 4) whereby an extendable and recessing lens ring 24 operates to restrict a beam focal point (through extending the length from light source to lens) and widen a beam focal point (by lessening the distance of light source to lens) as is shown generally in FIGS. 14*b* and 14*c*, respectively. Specifically, light system 60 itself is comprised of 3 (three) actuatable and illuminable light sources (light source 61, light source 62 and light source 63 as depicted in FIG. 8), wherein movement away from light sources 61, 62 and 63 results in an extended configuration (shown in FIGS. 2, 3 and 14*b*) and lens ring 24 is projected and extended beyond flashlight front end 18 and front end ring 18*a* causing a focused beam and wherein lens ring 24 retraction (as depicted in FIGS. 1, 4, 14*c*, 15, 19 and 20) causes a beam widening. It is as well to be recognized that intermediate positions between full extension and full (recession) retraction cause correspondingly lesser degrees of the above narrowing and widening. The rear end 14 of the flashlight is made to accommodate a tail cap 28 with a rotatable tail cap switch 30 that moves in and out (i.e. toward and away) from the tail cap 28 for increasing and decreasing intensity of the light beam via rheostatic resistance modulation. As well, the dual function of external charging of internal batteries (FIGS. 4 and 8) and external commands (see FIGS. 28 and 30) may be accomplished through removal of charging cap 89 and insertion of a charging device (FIG. 42) and/or a command device, respectively. Finally, and most important to the present invention, flashlight 10 encompasses an internalized mechanism for advancing a cam follower 46 in a linear, planar motion that positions the internally deposed light system 60 perpendicular to both the axially running power supply (i.e. battery) and front-facing lens thereby resulting in various color changes via activation of a set number of individually actuated light sources 61, 62 and 63.

Figure 3:
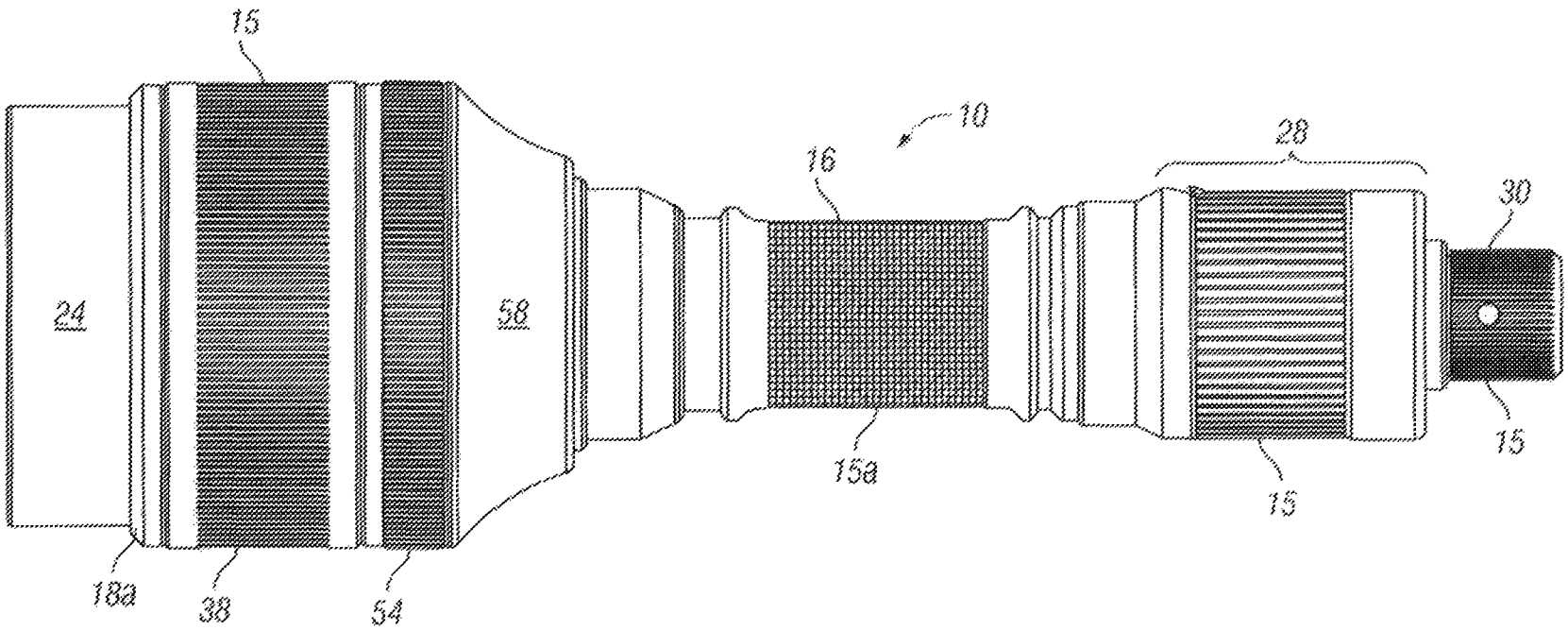
FIG. 3 illustrates a side view of the flashlight of FIG. 2.

As shown in FIG. 3, the flashlight 10 has various parts that are held, rotated and moved that have exterior surfaces that are knurled with a pattern of lines to assist in handling and gripping. Label 15 indicates knurling wherein knurling is exhibited about the circumference of the flashlight 10 with raised indentions running parallel to a centrally running axis of the flashlight 10 (and yet it is further within contemplation of inventors to distribute knurling horizontally or in a cross-hatch pattern). FIG. 3 further shows diamond (i.e. cross-hatched) knurling 15*a* on the middle body 16 of the flashlight together with axially parallel knurling 15 on tail cap switch 30, tail cap 28, cam ring 54 and exterior ring 38, descending spatially from a rear end 14 to front end 18. It is within the scope of this invention, both in its utility aspects and in its design aspects, for some or all of this knurling to be interchanged, enhanced or deleted altogether.

While FIGS. 1-3 depict primarily external features, FIGS. 4-23 show several views of various internal parts and internalized operable mechanisms of the flashlight 10.

Figure 4A:
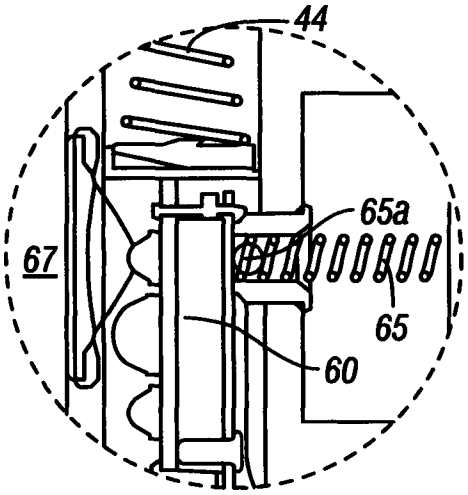
FIG. 4*a* illustrates an enlarges operationally functional portion of the light source in FIG. 4.
Figure 4:
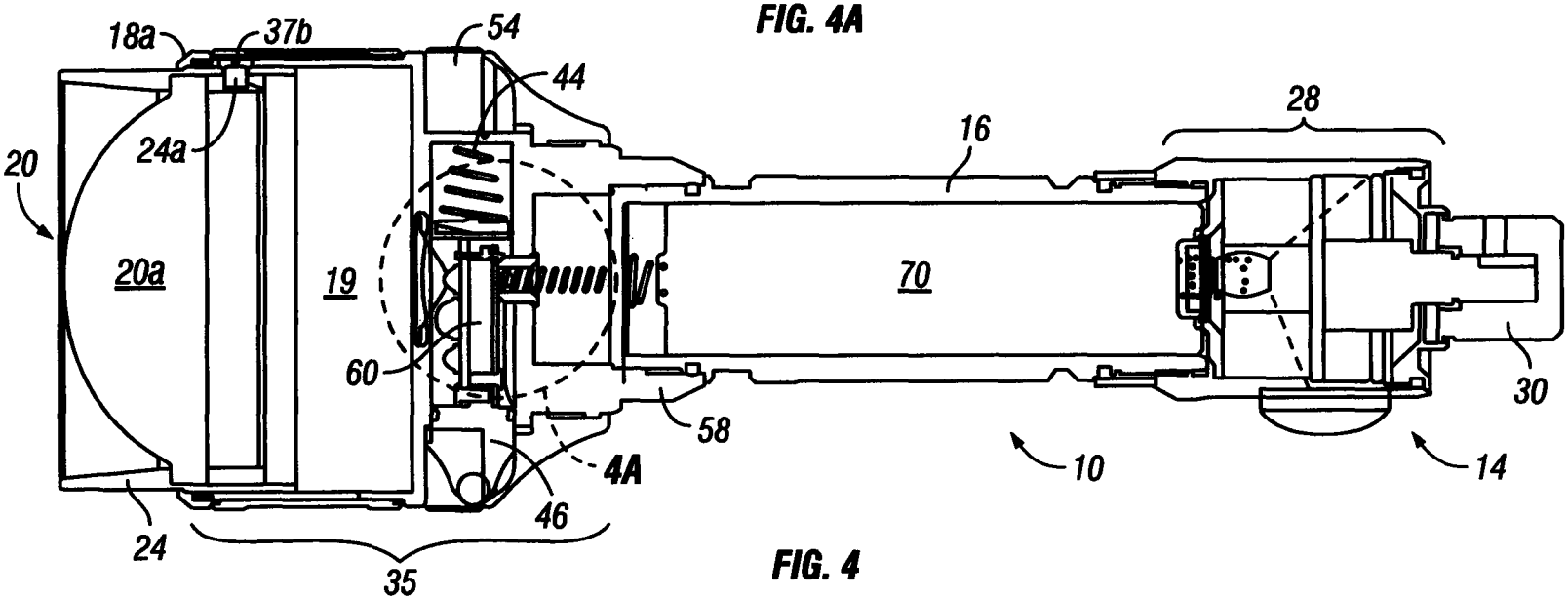
FIG. 4 represents a side internal cross-section view of the flashlight of FIG. 1.
Figure 5:
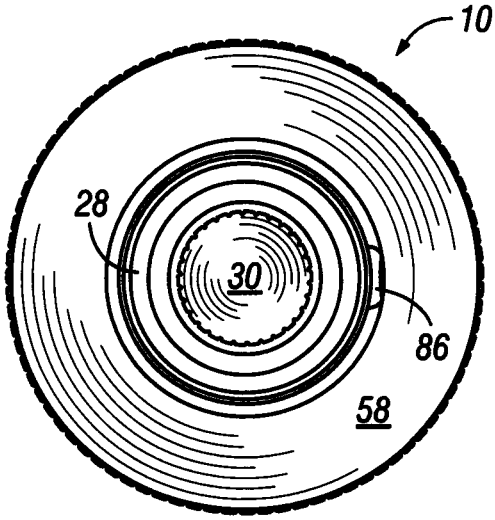
FIG. 5 is a rear view of the flashlight of FIG. 1.
Figure 6:
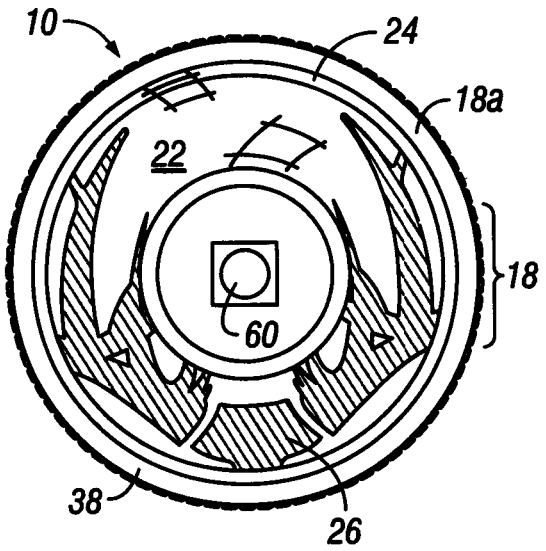
FIG. 6 depicts a front view of the flashlight of FIG. 5 with an embedded design.

As depicted in FIG. 4, and more specifically detailed in FIG. 4*a*, lens 20 is mounted in a lens ring 24 which is adjustably positioned in front of a light system 60 and is made for extension and retraction whereby decreasing space 19 results in a wider beam and increasing of space 19 results in a narrower beam (as projected through curved lens surface 20*a*). Said lens ring 24 maintains the lens 20 securely within the lens ring 24 allowing for light beam focus via advancement and retraction of said lens 20 and lens ring 24 combination. FIGS. 4, 4*a* and 8, evidence the functional and operation elements responsible for color (i.e. light source 61-63 selection), via movement of light system 60 linearly through movement of cam follower 46, wherein cam follower 46 moves perpendicular to inferior conducting spring 65 and appended ball bearing 65*a* and superiorly positioned aperture 67 within space 23 due to spring 44 opposition and cam ring 54 rotation.

As is evident in FIG. 4, lens ring 24 movement is actuated by an inserted screw 37*b* extending through groove 37*c* in stationary and cylindrical lens mounting ring 37 (see specifically FIGS. 14*a*-14*c*) and into a threaded accepting hole 24*a* (FIG. 4) placed in the exterior surface of adjustable lens ring 24. Lens mounting ring 37 abuts cam ring 54 which is in immediate contact with outer bell cover ring 58 whereby the three features (lens mounting ring 37, cam ring 54 and outer bell cover ring 58, respectively) form the complete head unit 35 of flashlight 10. The lens mounting ring 37 itself is slightly larger than the adjustable lens ring 24 and is made to accommodate the extension and retraction, via lens mounting ring rotation, within certain preset limits, of adjustable lens ring 24. What is more, the lens mounting ring 37 extends rearward to create a foundational support for the adherence of both the cam ring 54 and outer bell cover ring 58 through a stationary post 42 (see FIGS. 8 and 10) which is flush at the intersection of stationary post 42 and cam ring 54 communication, to allow for ease of rotational movement of cam ring 54 about stationary post 42, and is threaded at the point of communication of stationary post 42 and outer bell cover ring 58 to provide for securing of cam ring 54 against the posterior surface of lens mounting ring 37 allowing for fixed and uninterrupted cam ring 54 rotation. The lens mounting ring 37 inner circumference is just slightly larger than the outer circumference of adjustable lens ring 24 which is made to exhibit an inner groove 38*a* that is made to run parallel to the flashlight axis (not shown) whereby lens ring 24 fits in and moves with respect to the outer ring 38. Therefore, adjustable lens ring 24 is made to move rotationally outward, and inward, via potentiation of lens ring 24 attached screw 37*b*, which is influenced to move, through rotation of outer ring 38 and, corresponding persuading of internally disposed groove 38*a* of outer ring 38. Particularly, movement of the lens ring 24 is effected by rotating the exterior ring 38 which encompasses and moves the ring 24 where exterior ring 38 has internally disposed groove 38*a* that captures and holds the top of screw 37*b* so that as the exterior ring 38 rotates screw 37*b* in the groove 37*c* of the ring exterior ring 38 and this movement of the screw 37*b*, attached to the lens ring 24, thus moves the lens toward and away from stationary light sources 61-63 of the flashlight 10, i.e. toward and away from the light system 60. This provides for the adjusting of the beam width and/or focus of the light from the light system 60 and primary functioning light sources 61-63. Specifically, lens adjustment away from the light source provides a narrowing, focused beam and movement toward the light source provides a wider, dispersed beam. Moreover, beam intensity is directly related to focus wherein the narrow, focused beam has greater light intensity and wider, dispersed beams are correspondingly of a lesser intensity (as shown by the arrows in FIG. 10).

Figure 7:
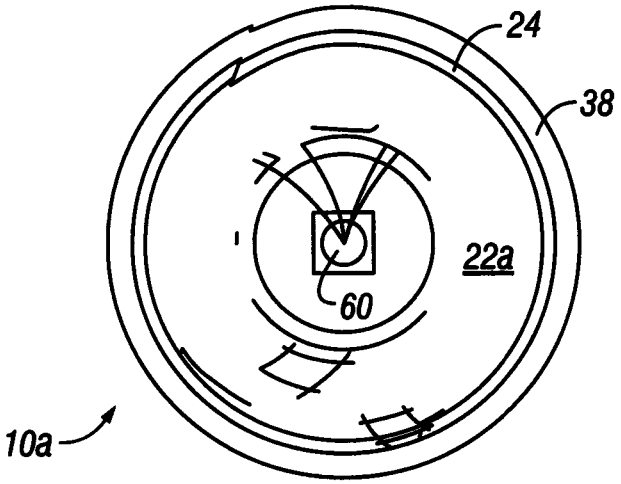
FIG. 7 is a front view of an optional version of a flashlight like that of FIG. 6 without an embedded design.
Figure 8:
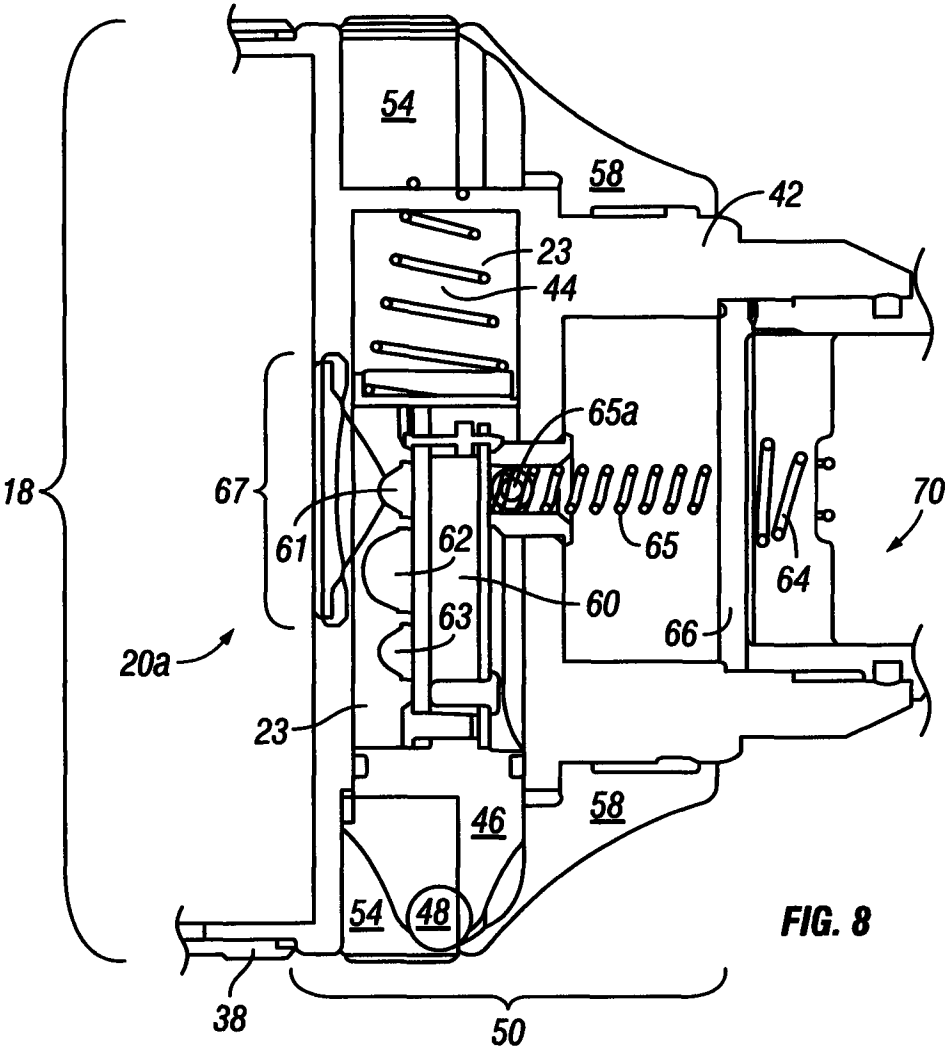
FIG. 8 represents an enlarged and expanded view of the internalized mechanism of the present invention showing certain internal parts of the flashlight enlarged for clarity.

With respect to the inner reflective surface, FIG. 7 shows an embodiment of the present invention flashlight 10*a* in which there is no image on the interior reflective surface 22*a* of the flashlight's interior. In opposite, and according to FIG. 6, inner reflective surface 22 is made to contain image 26 which may be any logo, artwork, design, etching, decal, sticker, photo, shape, indicia, trademark, likeness, or pattern. For example, and not by way of limitation, the image 26 exhibits a logo that is the image of stylized antlers adhered to inner reflective surface 22. The image may be painted on, presented on a decal or sticker affixed to the surface 22*a* within the interior of the flashlight, etched, or engraved on the body of inner reflective surface 22 or 22*a*. Optionally, the surface 22*a* may be a reflective or mirror surface which may be covered with or made of heat insulating and/or absorbing and/or dissipating material.

Color Selection

Figure 9:
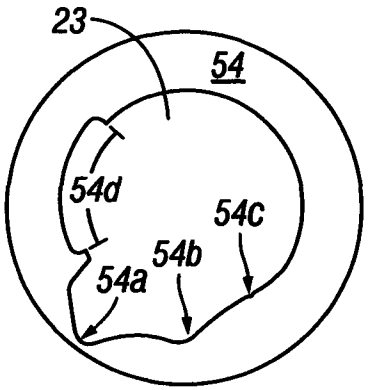
FIG. 9 is a superior view of a cam ring cross-section with inner cam surfaces.
Figure 10:
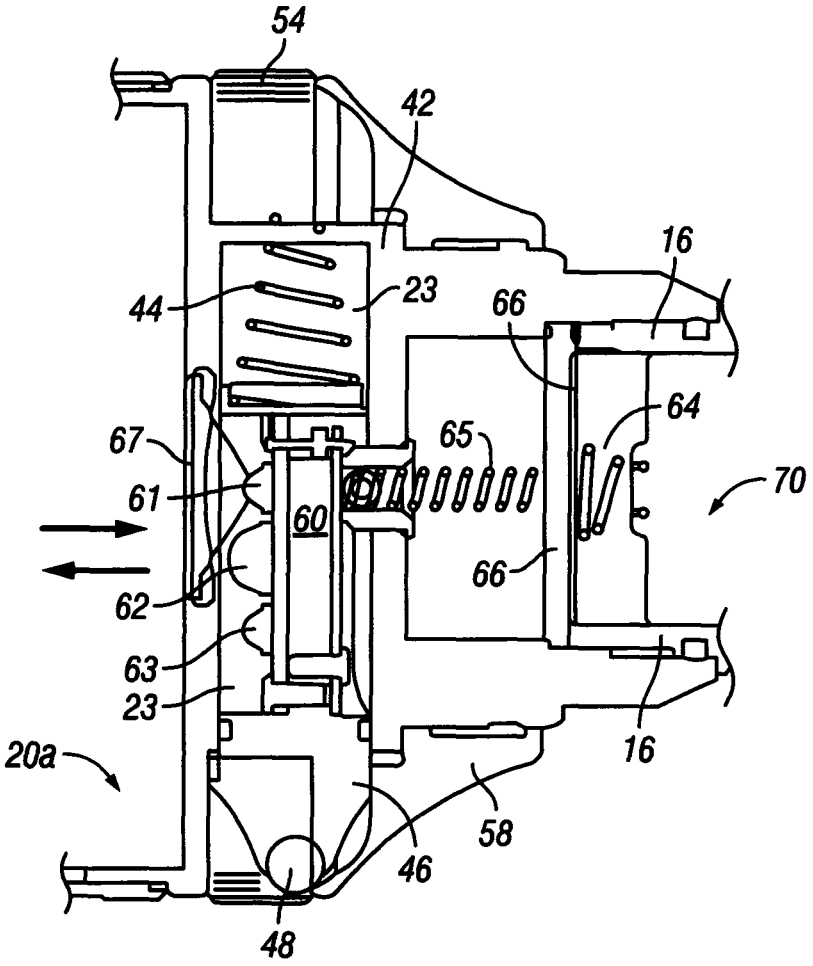
FIG. 10 illustrates a side view of the internal parts of the flashlight of FIG. 1.

Operationally, color change and color selection is achieved, as depicted in FIGS. 4, 4*a* and 8-11*c*, wherein light selector system 60 movement is potentiated via cam ring 54 rotation with cam follow 46 advancing along the inner surface of cam ring 54 distinct cam surfaces 54*a*, 54*b* and 54*c*, (see specifically FIG. 9) each corresponding to an individual (actuatable) light source 61, 62, and 63 in FIGS. 8 and 10. It is within the scope of this invention to have one or a plurality of light emitting sources (i.e. light sources 61-63), that may be any suitable light source, not limited to bulb(s), LED lights, or a combination of both. When there is more than one light emitting source, they may all emit the same color light with the same intensities or different colors and varying intensities, or a combination thereof. Specifically, FIG. 8 shows the primary functioning light changing mechanism in the form of a light selector system 60 operable through interdependence of cam ring 54 and cam follower 46 wherein cam follower 46 is fixed between urging spring 44 and the inner surface of cam ring 54 surface at positions 54*a*, 54*b* and 54*c* as secured within an enclosed channel, cam follower space 23 whereby individual light sources are energized through communication of battery 70, via yieldably urging and conductive spring 64, through electronic circuitry system 66, into a second yieldably urging, conductive spring 65 and distally appended conductive ball bearing 65*a* to energize and create light production as ball bearing 65*a* slidably moves across a dedicated path from cam surface/conductive elements 61*a* to cam surface/conductive element 62*a* to cam surface/conductive element 63*a* and rotatably selectable back to cam surface/conductive element 62*a* and cam surface/conductive element 61*a* (see FIG. 22) thus providing actuation of each light source 61-63 individually. Light activated through light system 60 is then projected through aperture 67 through lens space 20*a*, as shown in FIG. 8, and onto lens 20 as shown in FIG. 4.

The cam ring 54, as shown cross-sectionally across the flashlight midline in FIGS. 8 and axially in FIG. 9, rotates clockwise and counterclockwise about the outer circumference of flashlight 10 encircling the light system 60 and encompassing, and moving with respect to, a cam follower space 23 within the cam ring 54 center in which the cam follower 46 moves. In sum, flashlight stationary post 42 serves multiple additional integral functions, in addition to the above foundational support for the adherence of both the cam ring 54 and outer bell cover ring 58 externally, including that of cam follower 46 housing, middle body 16 securely accepting receptacle, electronic circuitry system 66 seat, battery 70 housing and energy conduit (linking battery 70 with light system 60 via securely stationed electronic circuitry system 66 wherein conductive spring 64 selectively resists the downward pressure of battery 70 and the upward pressure of conducting spring 65), internally. FIG. 10 illustrates each of the above referenced features wherein middle body attachment, power supply, power conveyance, light selection and lens movement are incorporated into a single depiction.

Figure 11C:
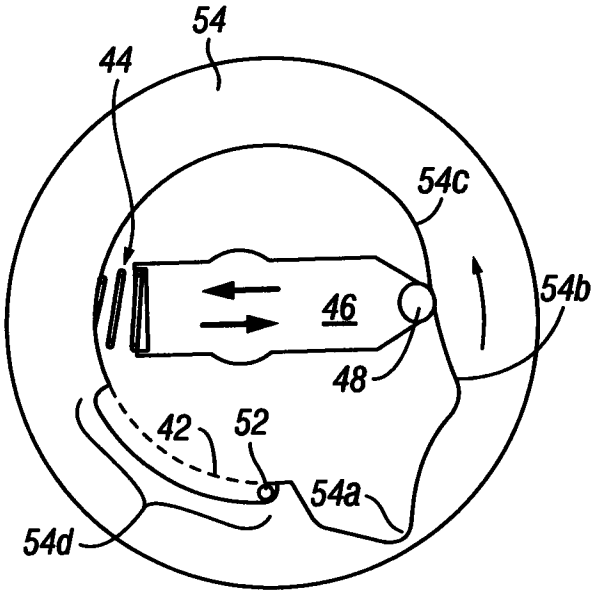
FIG. 11*c* is a cross sectional view of a cam follower within a cam ring in position 3 corresponding to light source 3.
Figure 11B:
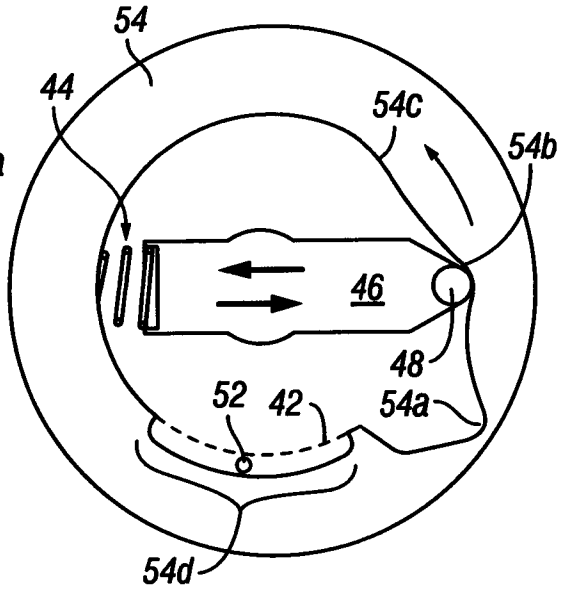
FIG. 11*b* is a cross sectional view of a cam follower within a cam ring in position 2 corresponding to light source 2.
Figure 11A:
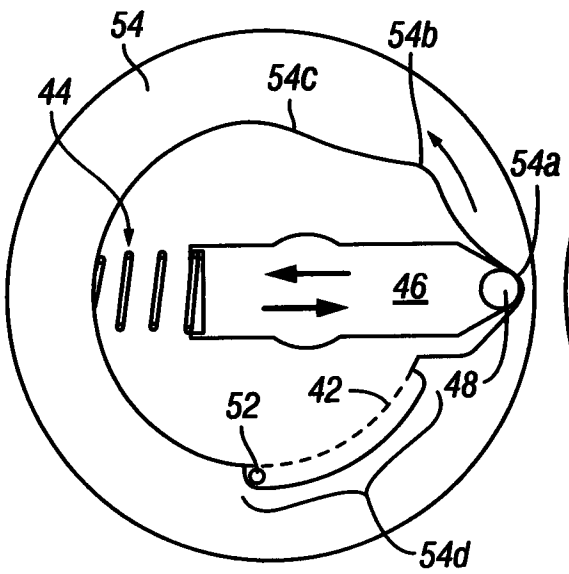
FIG. 11*a* is a cross sectional view of a cam follower within a cam ring in position 1 corresponding to light source 1.
Figure 13:
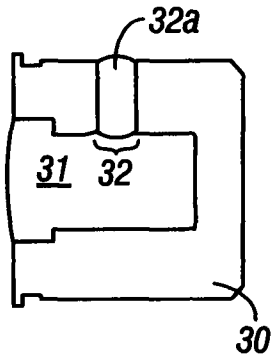
FIG. 13 shows a cross section of an enlarged view of the tail cap and end switch of FIG. 12
Figure 12:
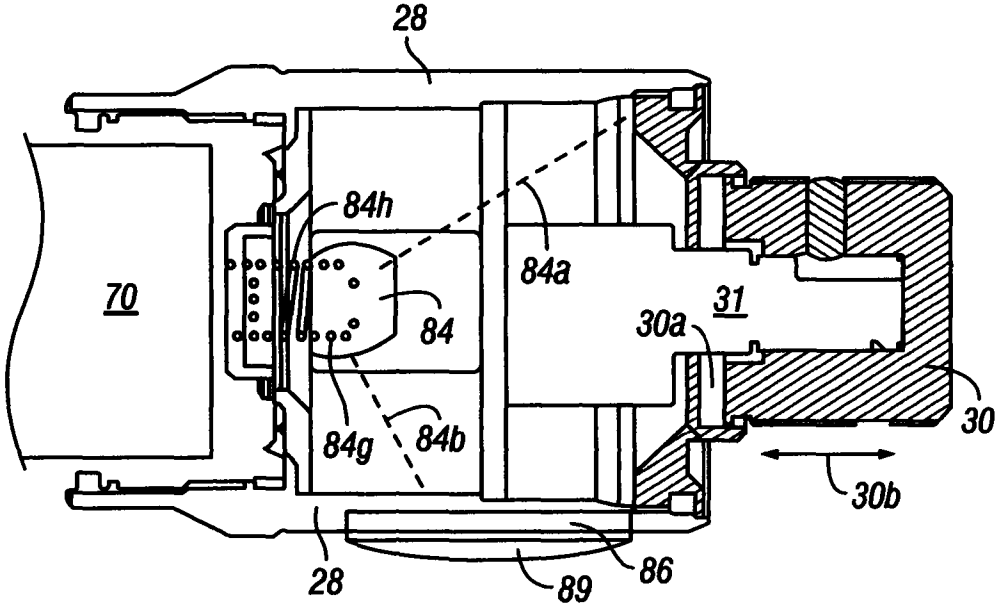
FIG. 12 is an enlarged view of internal parts including a tail cap and end switch.

FIG. 11*a*-11*c* represent light source selection through cam ring 54 clockwise and counterclockwise rotation and yieldably opposable spring 44 compression and expansion where FIG. 11*a* illustrates cam follower 46 communicating with cam ring 54 inner surface 54*a* via cam follower ball bearing 48 corresponding to light source 61 selection, FIG. 11*b* illustrates cam follower 46 communicating with cam ring 54 inner surface 54*b* via cam follower ball bearing 48 corresponding to light source 62 selection and FIG. 11*c* illustrates cam follower 46 communicating with cam ring 54 inner surface 54*c* via cam follower ball bearing 48 corresponding to light source 63 selection. Further, although FIGS. 11*a*-11*c* depict cam ring 54 clockwise rotation and subsequent counterclockwise cam follower 46 advancement (arrow) from 54*a* to 54*b* to 54*c*, it is understood that when cam follower moves from 54*a* to 54*b* (evidenced in resultant configuration in FIG. 11*b*) cam follower 46 could advance to either 54*c* or back to 54*a*. Also, where, as illustrated sequentially from FIG. 11*a* to 11*c*, movement from 54*a* to 54*b* to 54*c* is visually enumerated, although the reverse is also within the contemplation of inventors (e.g. movement from FIG. 11*c* to 11*b* to 11*a*, via counterclockwise cam ring 54 rotation). Arrows on the circumference of cam ring 54 indicate cam follower 46 advancement and internal, centrally deposed, inward and outward direction arrows indicate cam follower 46 advancement and spring 44 compression and release.

Figure 21:
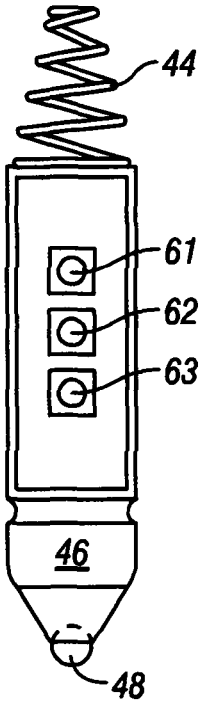
FIG. 21 is a superior view of the cam follower of the flashlight of FIG. 4, including opposable urging spring and light sources.
Figure 22:
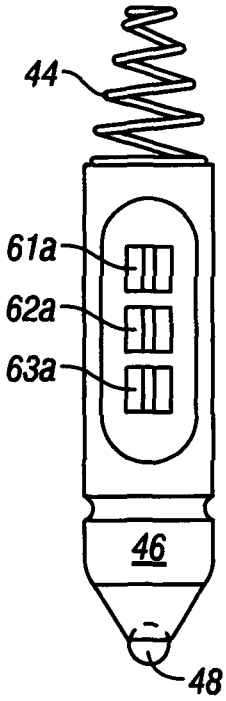
FIG. 22 is an inferior view of the cam follower as shown in FIG. 21, including opposable urging spring and conductive elements.
Figure 23:
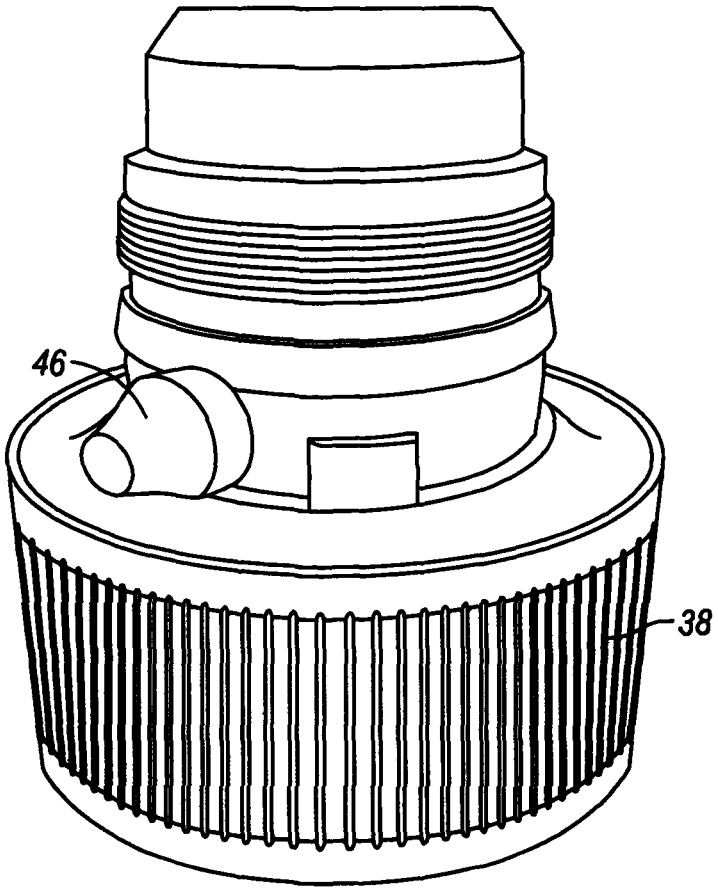
FIG. 23 is a side perspective view showing the tip and the movable cam follower member as shown in FIGS. 19-22, without cam follower ball bearing.

In one aspect of a translocatable cam follower 46, and not by way of limitation, one embodiment of the cam follower 46 as shown in FIG. 21 (superior view) and FIG. 22 (inferior view), the light source 61 of FIG. 21 may be a red LED light source corresponding to a cam surface/conductive element 61*a* of FIG. 22 wherein light source 61 is oriented 180 degrees from cam surface/conductive element 61*a*, the light source 62 of FIG. 21 may be a green LED corresponding to cam surface/conductive elements 62*a* of FIG. 22 wherein light source 62 is oriented 180 degrees from cam surface/conductive element 62*a*, and the light source 63 of FIG. 21 may be a white LED corresponding to cam surface/conductive elements 63*a* of FIG. 22 wherein light source 63 resides 180 degrees from 63*a* although any arrangement of like or different colors in various orders and arrangements are in the contemplation of inventors.

It is within the scope of the present invention to provide, in addition to an inner keyed surface of cam ring 54 of variable heights (alternatively viewed as depths) corresponding to 54*a*, 54*b* and 54*c* (see FIG. 9 cam ring 54 used for light source 61, 62 or 63 selection via movement of cam follower 46 within said inner keyed surface), a dedicated keyed area 54*d* wherein a post, in one preferred embodiment a screw, is embedded into the exterior of stationary post 42. As illustrated in FIGS. 9, 11*a*-11*c*, a stop measure in the form of a screw 52 exhibiting a screw head, is embedded into the stationary post 42 encircled by cam ring 54 and projects away from stationary post 42 into a key area 54*d*, preventing the cam ring 54 from being moved further in either direction, and limiting movement of the cam ring follower 46 via cam ring 54 rotation along a predetermined path along the surfaces 54*a*-54*c*. As shown in FIGS. 11*a*-11*c*, cam ring 54 includes keyed surface areas 54*a*-54*c* and a reciprocal and corresponding restricted path for movement within space 54*d* and working in conjunction with, and in support of, specific cam surface indentions, specifically 54*a*, 54*b* and 54*c*, for disposition of the cam follower tip 48 into the inner key surface indentions. The inner key surfaces have support, through stationary post 42 into a key area 54*d*, such that the cam follower 46, via cam follower tip 48, can move only along the keyed surface, but cannot move out of or beyond the key surface, thereby preventing the cam ring 54 from moving beyond preset limits corresponding to each keyed surface and the keyed surface being of sufficient dedicated length that the cam follower 46 can be moved to one of the selected cam surface indentions 54*a*-54*c*, to select a desired light source, but not beyond those points, namely 54*a* and 54*c*.

As shown for the particular embodiment shown in FIGS. 4, 10, 21 and 22, the light system 60 has a moveable member in the form of an spring 44 urged and induced cam follower 46, three LED lights 61, 62, 63 (each with rear conductive elements 61*a*, 61*b*, 61*c* respectively) that are energized through the connection of battery 70 through opposing spring 64 of stationary electronic circuitry system 66 which exhibits a second conductive spring 65 that is made to conduce electrical energy to presented conductive elements 61*a*-63*a* and on to LED lights 61,62,63 for light illumination and light beam forming. The light sources 61-63 are secured onto the front-facing surface of the movable cam follower 46. The cam follower 46 displays a cam follower tip 48 wherein lies a ball bearing 48 that moves along the inner surfaces of the cam ring 54 as the cam ring 54 is rotated for selecting one of the aforementioned light sources 61-63. Spring 44 yieldably urges cam follower 46 (via the cam follower tip 48) against the inner cam surface and the force of the spring 44 is overcome by an operator moving the cam ring 54 rotationally clockwise or counterclockwise, via application of an overcoming force greater than that of the urging spring and inner cam surfaces, as per selectable and desired light source illumination color. The cam follower tip 48 is movable into and out of contact with the cam surfaces 54*a*, 54*b*, 54*c* of the cam ring 54 as the cam ring 54 is rotated. Measured heights of the inner cam ring 54 surfaces provide interior cam surfaces affording stops (that can be overcome through application of rotational force) to releasably hold the cam follower tip 48 of the cam follower 46 within a selected cam surface and within each cam follower "stop". Outer bell cover ring 58 is removably secured about the stationary post 42 and over the upper cam ring 54 surface as to provide a tapered edge securing the inner functional mechanisms (i.e. the cam ring 54, cam follower 46 and cam tip 48 in place) to insure secured operation and protection of these vital operable elements.

Optionally, and as shown in the FIGS. 4, 10, 11 the cam follower tip 48 may be, but is not limited to, a rotatable ball bearing 48 mounted and secured within an ball bearing accepting indention in the end of the cam follower 46 as the cam follower tip 48. Alternatively, the cam follower tip 48 may be simply a polished end or an end made of a low friction material in order to move along the inner surface of the cam ring 54.

Spring 44 yieldably urges cam follower 46 via cam follower tip 48 against an abutting inner surface of cam ring 54 so that a selected light source 61-63 is releasably held in the desired position to accept battery 70 power through spring 64, electronic circuitry system 66, spring 65 and ball bearing 65*a*. The force of the spring 44 is such that it can be overcome and compressed by rotating cam ring 54, leading cam flower tip 48 along a dedicated internalized path of the cam ring 54 to a desired depth (signified as 54*a*, 54*b* or 54*c*) wherein movement of cam follower 46 from inner cam ring 54 surface 54*a* to surface 54*b* changes beam color from red (LED 61 via rear conductor 61*a*) to green (LED 62 via rear conductor 62*a*) and movement from surface 54*b* (LED 62 via rear conductor 62*a*) to surface 54*c* (LED 63 via rear conductor 63*a*) changes beam color from green to white.

Although, the color choice is arbitrary and can be changed without departing form the overall function.

Power is supplied to the light source(s) 61-63 from the battery 70 via spring 64, an electronic circuit system 66 and spring conductor 65 (together with appended, conductive ball bearing 65*a*) providing for the conducting of electrical power from the battery 70 to the conductors 61*a*, 62*a* and 63*a* of the light sources 61, 62 and 63. Optionally electrical power flows through a spring which serves as the conductor 65 and a ball bearing 65*a* which is rotatably mounted in the end of the spring 65 for contacting the conductors 61*a*-63*c* for illumination of light sources 61, 62 and 63. Movement of the conductor 65 with respect to and in contact with the conductors 61*a*-63*c* is facilitated by the ball bearing 65*a*. Any suitable known conductive material for a ball bearing may be used and any conduit that allows for fluid movement of the tip of conductive spring 65 is an acceptable alternative (see cam follower tip 48 (supra)).

For modulation of power and light intensity, an electronic controller 84, in the form of a combination power switch and rheostatic controller utilized to control the flow of current in an electric circuit is contemplated to afford the user the ability to both turn the present flashlight invention 'on' and 'off' and to adjust the intensity of the light beam to thereby dim and brighten the projected light source. Shown schematically in FIGS. 4 and 12, tail cap 28 (as also illustrated in FIGS. 2 and 3), with connections 84*a* and 84*b*, also shown schematically, interfaces with the tail cap switch 30 to control power from the battery 70 through the electronic circuitry 66 via springs 64 and 65 in order to turn the power 'on' and 'off', to selectively lock out the power (avoiding inadvertent activation) and to provide for dimming/brightening the light(s). In concert with the connection device 86, the controller 84 provides for charging of the battery 70 (upon removal of the charging cap 89 and installation of a charging cable connected to a charging device or power source and, with the connection device 86, accessible when the charger cap 89 is removed, to interface with an independent controller device, e.g. but not limited to as the devices in FIGS. 28 and 30 and via control device 600 in FIG. 42. A conductor 84*g* and a spring 84*h* provide a power pathway from (and to) the battery 70 for the controller 84.

As depicted in FIGS. 1-5, 12 and 13, the tail cap switch 30 can be rotated and incrementally adjusted via a rheostat control to adjust the power to the light(s), for dimming the light(s) or for increasing brightness. Tail cap switch 30 can also be tapped (as designated by arrow 30*b*), to move in and out with respect to tail cap 28, within space 30*a*, wherein controller 84 responds to the tapping of the tail cap switch 30 so that different modes of operation, powering 'on' and 'off', locking out of power, and time delay of power are effected. For example, and not by way of limitation, in one aspect of such a flashlight with a tail cap 28 and a tail cap switch 30, tapping the tail cap switch 30 once turns the flashlight on, and then tapping it once again turns it off. Also by way of example, holding the tail cap switch 30 in for an adjustable time period (e.g. 5 seconds) locks out the power and the flashlight cannot then be turned on unless the tail cap switch 30 is then again held in for an adjustable time period (e.g. 5 seconds) and the light(s) flash twice to indicate that the flashlight is unlocked and power is now available, at which point tapping the tail cap switch 30 once will turn the flashlight on.

It is as well within the scope of the present invention to provide new and nonobvious combinations of an item and the present invention that is a flashlight.

Figure 24:
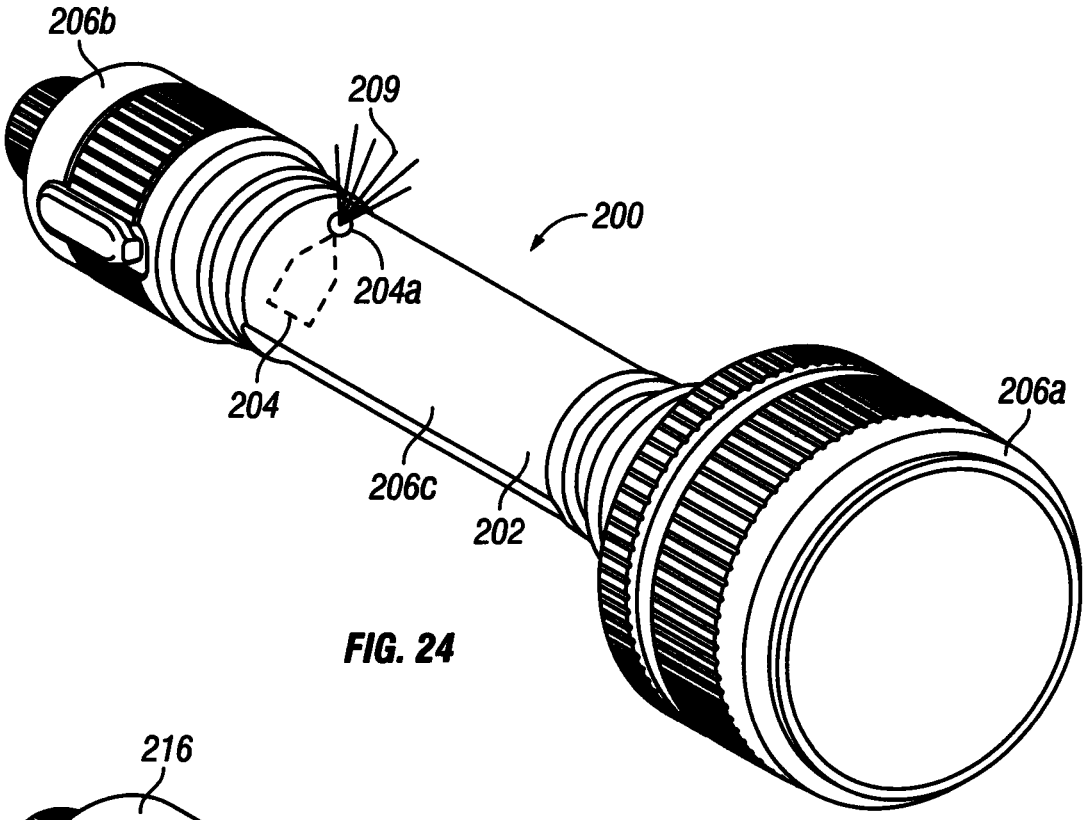
FIG. 24 presents a superior perspective view of an emitter system within a flashlight, according to the present invention.

For example, according to one embodiment, and not by way of limitation, FIG. 24 shows a flashlight 202 and emitter 204 combination 200 wherein flashlight 202 comprises a an front end 206*a*, rear end 206*b* and a middle 206*c* between end 206*a* and 206*b* and an emitter 204 contained internally within the flashlight 202 interior, depicted herein within flashlight middle 206*c*. The flashlight may be any suitable, known flashlight and includes, but is not limited to, a flashlight according to the present invention wherein emitter 204 may be placed at various locations within said flashlight 202 (e.g. within 206*a* or end 206*b*) or at a plurality of locations while achieving the same, similar or accentuated effects.

The emitter 204 may be any suitable known emitter that emits a substance, including, but not limited to, an attractant, perfume, a descenter, a repellant, and olfactory nullifying material (as that is understood and as, e.g. described and disclosed in U.S. Pat. No. 9,479,741). This olfactory-nullifying material (ONM), substance or chemical, in whatever form (e.g., gaseous form, vapor form, liquid form, solid form, particulate or semi-particulate form), can be introduced into an animal's (or person's) environment and taken up by the animal—e.g., inspired, coated on the skin or organ surface, inhaled, taken through the nose, or taken by mouth—to negate an animal's olfactory function. ONM can include, but is not limited to, ozone, oxidizers, and chlorine and any other substance or chemical that can negate an animal's olfactory function.

Figure 28:
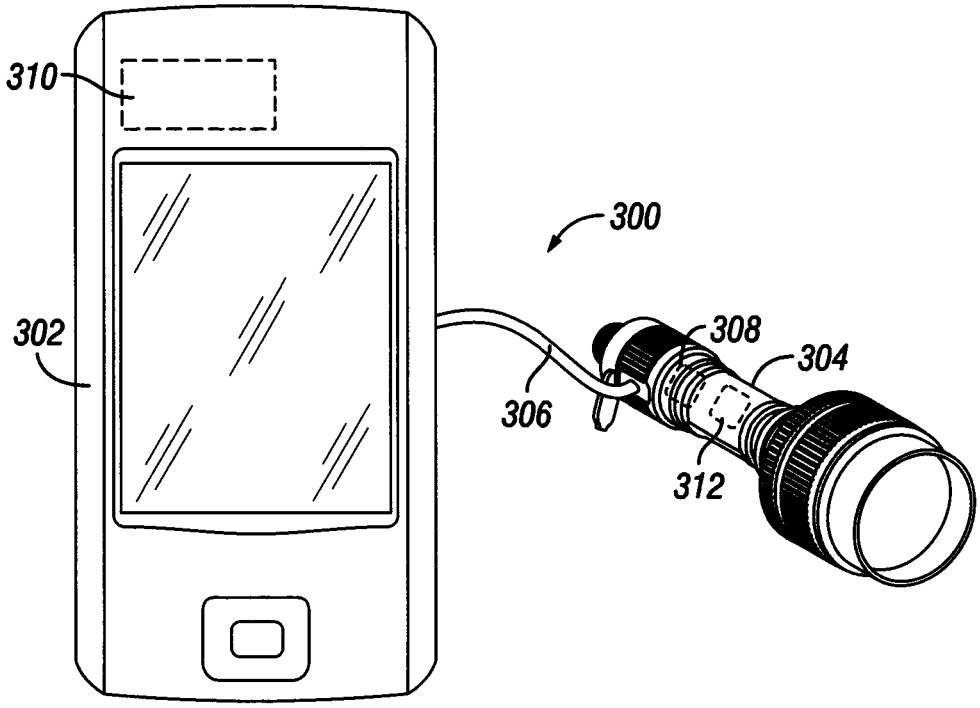
FIG. 28 is a perspective view of a wired system with a flashlight and a portable phone according to the present invention.
Figure 29:
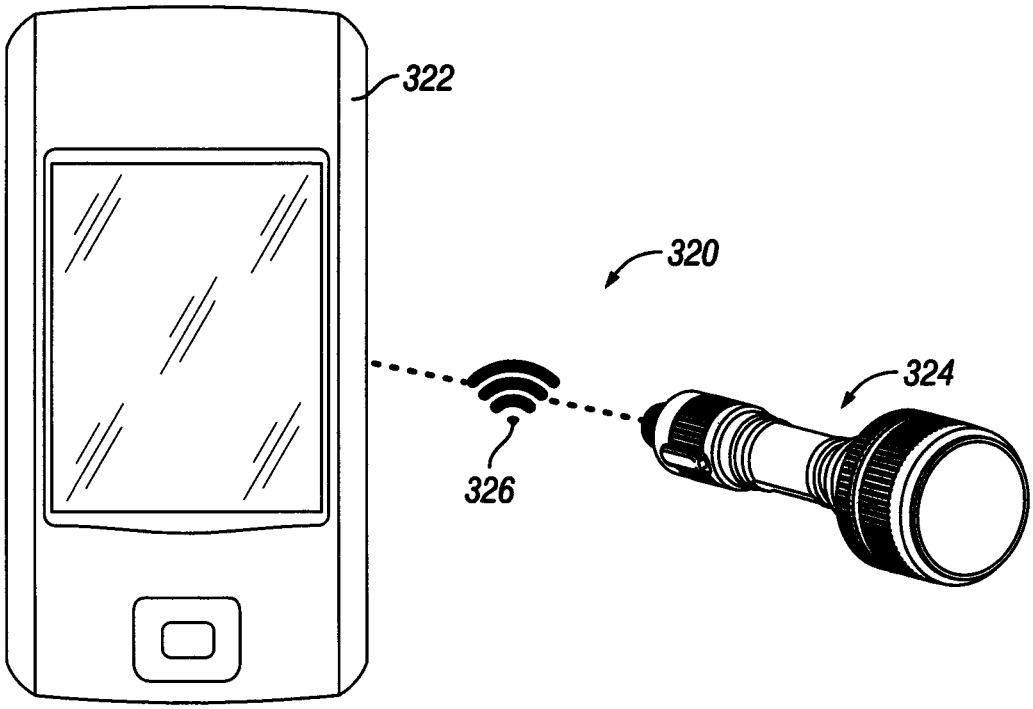
FIG. 29 is a perspective view of a wireless system with a flashlight and a portable phone according to the present invention.
Figure 30:
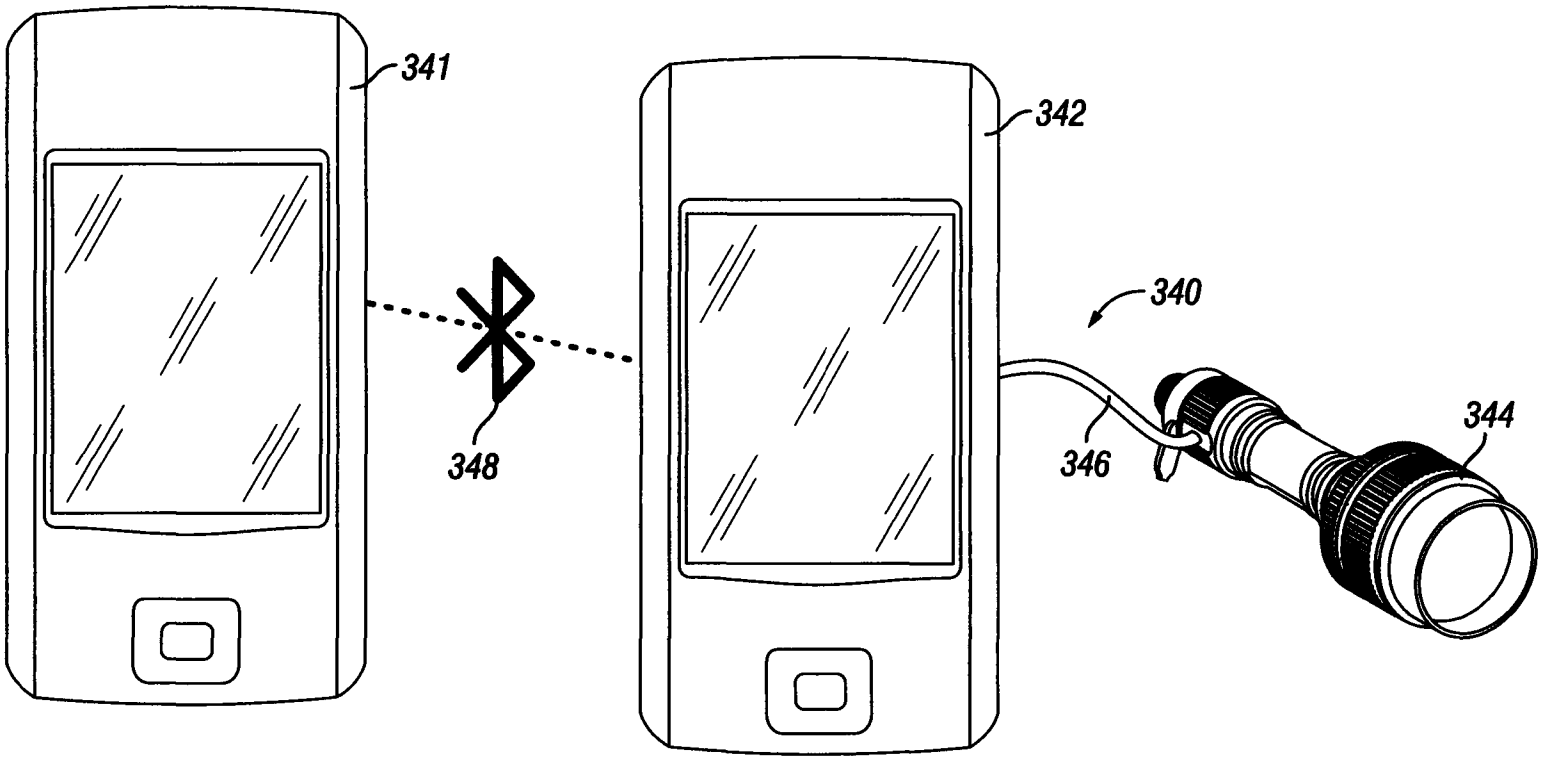
FIG. 30 is a perspective view of a wired and wireless system with a flashlight and portable phones according to the present invention.

As depicted in FIG. 24, material 209 may be expelled through a hole 204*a*. The emitter 204 can be a mechanical push-button emitter, manual push-top emitter, or an electronically controlled emitter controlled by appropriate control device(s) within the flashlight, either stand alone or in communication via the internet and/or via interconnection with a cellphone (as shown in FIGS. 28-30).

Figure 25:
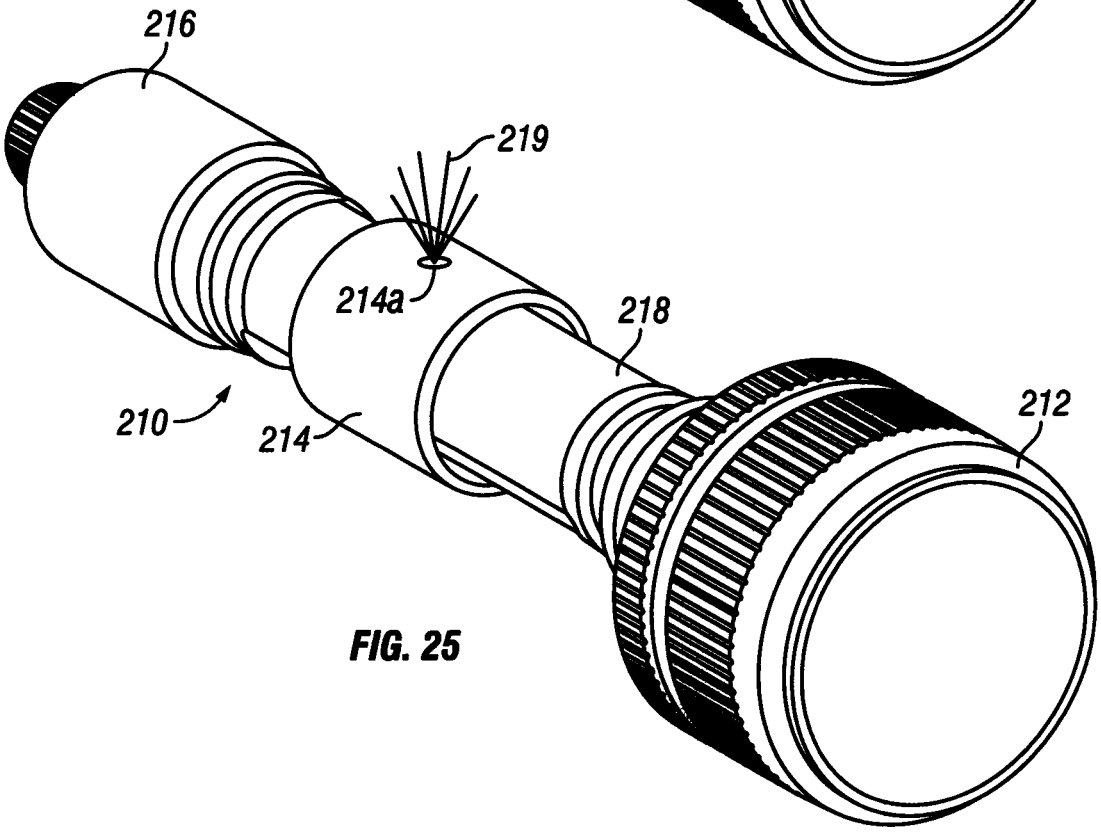
FIG. 25 presents a superior perspective view of an emitter system externally coupled to a flashlight, according to the present invention.

It is within the scope of the present invention to provide a system that includes a flashlight 200 and an emitter 204 that is located on the exterior of the flashlight 202, either formed integrally thereof or attached selectively releasably thereto. FIG. 25 shows a preferred embodiment, flashlight 210, according to the present invention, that has a forward end 212, a rear end 216 and a flashlight middle 218 where upon an emitter 214 is placed on the exterior of the flashlight 210 about the flashlight middle 218. Material 219 may be expelled through a hole 214*a*. The emitter 214 and its control may be as described as for the emitter 204 of the flashlight 200 above. Optionally, the emitter 214 may be slidably mounted on the middle 218 of the flashlight 210 for movement as desired. Optionally, the emitter 214 is held tight or movably in position at one or more sections up to and including flashlight forward end 212, flashlight rear end 216 and/or flashlight middle 218.

Notably, in any embodiment hereof, there may be two, three, four, or more multiple holes for expelling material from an emitter. These holes can be relatively close together, spaced apart or evidenced on different parts of the flashlight, incorporating appropriate material flow conduits, channels, tubes, or pipes.

Figure 26:
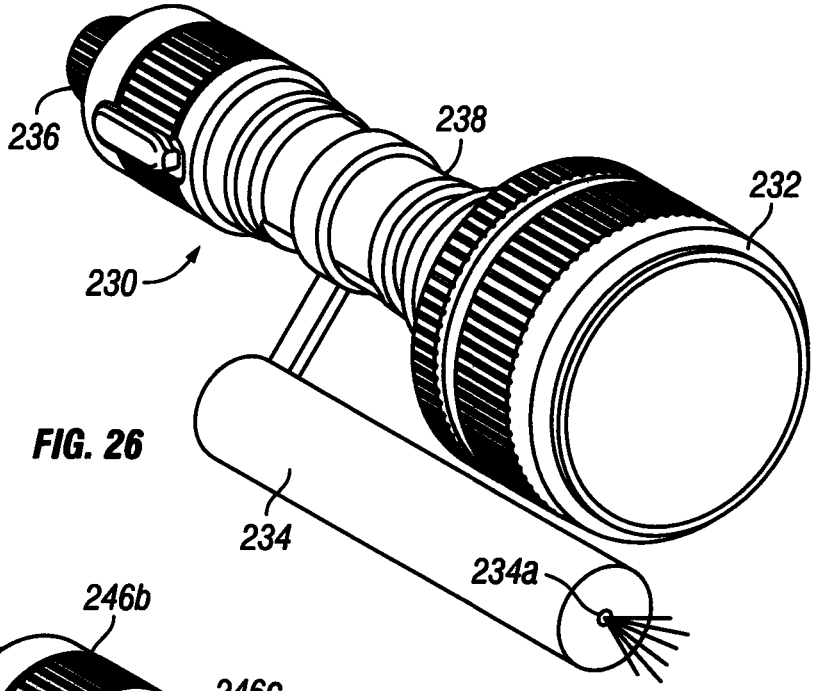
FIG. 26 presents a superior perspective view of an emitter system attached to and external to a flashlight, according to the present invention.

It is further within the scope of the present invention to provide a system that includes a flashlight 230 and an emitter 234 that expels material to the front of the flashlight. Specifically, FIG. 26 shows a flashlight 230 according to the present invention comprising front end 232 and rear end 236, a middle 238 and an emitter 234 attached to the exterior of and extending beyond flashlight 230. Material is expelled through a hole 234*a*. Optionally, the emitter is sized and configured so that the hole 234*a* is located forward of the front of the flashlight 230, although it is within the scope of the present invention to locate hole 234*a* at various locations about the flashlight 230 so long as material is expelled toward the front of flashlight 230. The emitter 234 and its control may be as described for the emitter 204 of the flashlight 200 above. Optionally, the emitter 234 may be slidably mounted on the middle 238 of the flashlight 230 for movement as desired, and, in certain aspects, to make it possible to move the hole 234*a* from a position in the front of the flashlight 230 to a position behind the flashlight 230. It is as well in the scope of the present invention to direct emissions rearward or omni-directionally as may be desired by the user.

It is also within the scope of the present invention to provide new and nonobvious combinations of an item and a flashlight in which the combination may be any item usable with or in connection with a light source, for example, but not limited to, a cooking utensil, knife, fork, spoon, fire-starter, headgear, hat, helmet, walking stick, cane, crutches, wheelchair, unicycle, bicycle, automobile, portable phone, truck, writing instrument, surgical implement, poker, clasp, pin, pointer, dental tool, dental instrument, or dental drill.

Figure 27:
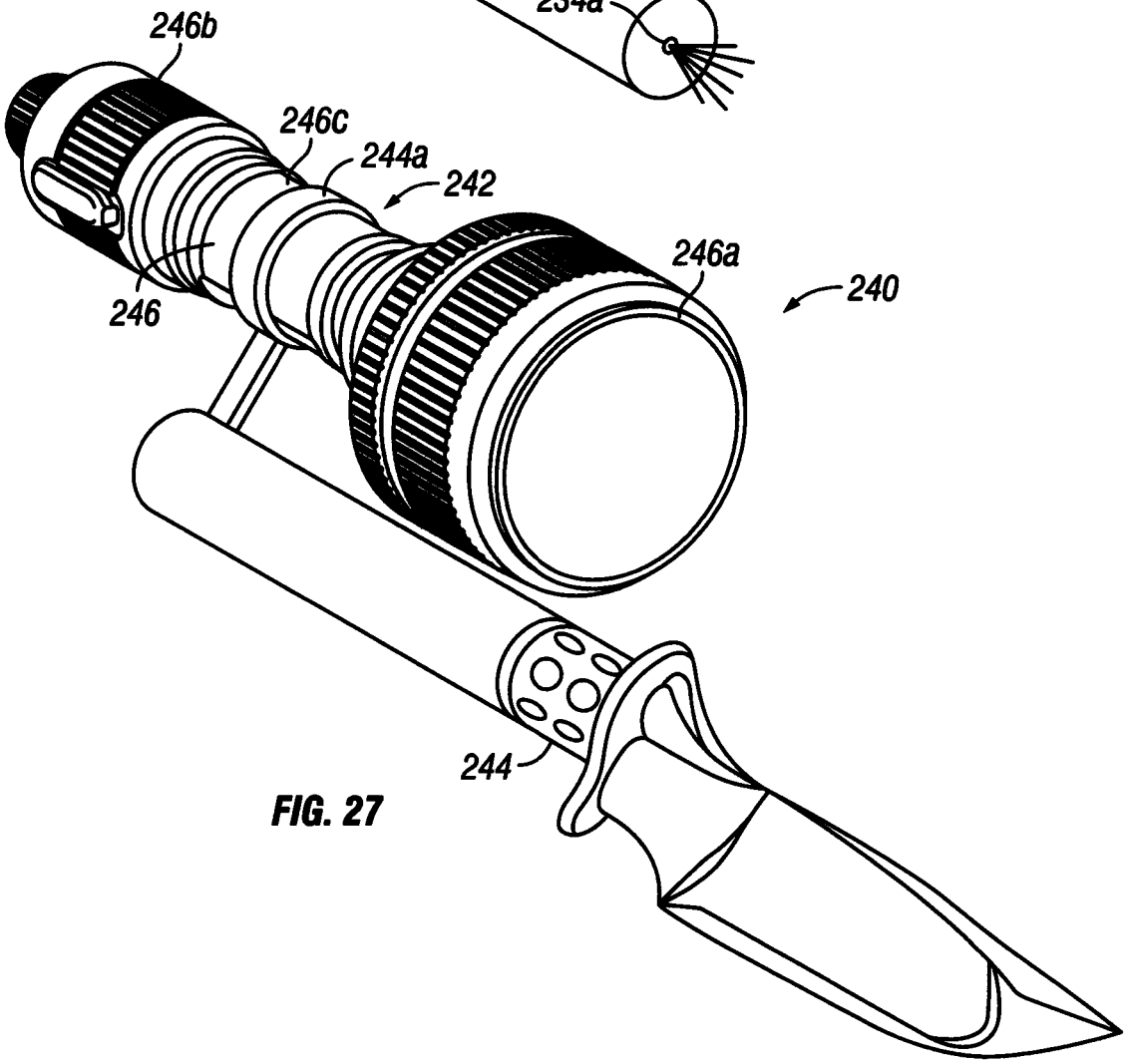
FIG. 27 presents a superior perspective view of an attachment system in the form of a bayonet and a flashlight, according to one embodiment of the present invention.

For example, and not by way of limitation, FIG. 27 shows a combination 240 of a flashlight 242 with a flashlight body 246 having a forward end 246*a*, a rear end 246*b*, a middle 246*c*, between the ends 246*a* and 246*b*, and a bayonet 244. The flashlight may be any suitable, known flashlight and includes, but is not limited to, a flashlight according to the present invention. The bayonet 244 may be any suitable known bayonet, sword, blade, rapier, epee, saber, or knife, any of which may be permanently connected to the flashlight, with a connection formed integrally of the flashlight body, or with structure that allows selective releasable connection 244*a* of the item to flashlight body 246.

It is additionally within the scope of the present invention to use and control a flashlight using a portable device (e.g. a portable phone, cellphone, iPhone, tablet computer and the like), or with a stationary device, such as, but not limited to, a desktop or laptop computer. The device (stationary or portable) can be in wired communication with the flashlight (e.g. by wire, cable, optic fiber, etc.) or the device can be in wireless communication with the flashlight. Optionally, the flashlight is in wired communication with a first device and a second device is in wireless communication with the first device and, in one particular aspect, and not by way of limitation, the two devices are portable phones.

FIG. 28 shows a system 300 according to the present invention that has a portable smart phone 302 and flashlight 304. The flashlight 304 may be any suitable known flashlight as shown and described herein. Via a cable 306, the flashlight 304 and smart phone 302 are in wired communication so that the flashlight 304 can be controlled using smart phone 302. The smart phone 302 has appropriate programming and/or application(s) ("app(s)") 310 for controlling features and functions of the flashlight 304 and flashlight 304 has appropriate reciprocating electronics 308 and mechanisms 312 so that flashlight 304 can be controlled using smart phone 302. The functions of flashlight 304 capable of being controlled by smart phone 302 include, but are not limited to, beam width adjustment, beam focus, beam intensity and powering on and off of the flashlight 304. Furthermore, powering on and off, modulation or actuation of any item connected to or used in combination with the flashlight (e.g. an emitter described in FIGS. 24-27) may be likewise controlled via appropriate reciprocating electronics. Likewise, flashlight 304 may receive power via connection 306 in order to operate, charge an internal battery or send and receive diagnostic inquiries and updates. Furthermore, it is within the contemplation of inventors to replace manual rotation (i.e. rotating cam ring 54, leading cam flower tip 48 along a dedicated internalized path of the cam ring 54 to a desired depth (signified as 54*a*, 54*b* or 54*c*) wherein movement of cam follower 46 from inner cam ring 54 surface 54*a* to surface 54*b* changes beam color from red (LED 61 via rear conductor 61*a*) to green (LED 62 via rear conductor 61*b*) and movement from surface 54*b* (LED 62 via rear conductor 62*a*) to surface 54*c* (LED 63 via rear conductor 63*a*) changes beam color from green to white) may be achieved electronically and directed through direct wired and/or wireless communication from a smart phone or tablet.

FIG. 29 depicts a system 320 according to the present invention that has a portable smart phone 322 and a flashlight 324. The flashlight may be any suitable known flashlight or flashlight 324 may be a flashlight according to the present invention. Via a wireless system 326, the flashlight 324 and the portable smart phone 322 are in a wireless communication so that the flashlight 324 can be controlled using the portable smart phone 322. The portable smart phone 322 has appropriate programming as described above for the portable smart phone 302 and flashlight 324 has appropriate electronics and mechanisms as described above for the flashlight 304. The wireless system 326 may be any suitable public or private communications system, including any suitable public or private network, including, but not limited to wireless WiFi®, Bluetooth® or other like conduits for information exchange via radio technologies.

FIG. 30 shows a system 340 according to the present invention that has two portable smart phones 341 and 342 (which may be any smart phone or device disclosed above, and may be the same or functionally similar to smart phones of FIG. 28 or 29), and a flashlight 344 (which may be any flashlight disclosed above, and may be the same or functionally similar to flashlights of FIG. 28 or 29), which may be any flashlight disclosed above, known or according to the present invention. Via a cable 346, flashlight 344 is in communication with smart phone 342 and via wireless system 348 (wireless network as described above) portable smart phone 342 is in communication with the portable smart phone 341. Either phone may control the flashlight 344, but power may be supplied preferentially through cable 346 (although charging may also be equally accomplished through inductive, wireless charging). Optionally, the two smart phones 341 and 342 may be in wired communication and the flashlight is in wired or wireless communication with one or both phones for both control and feedback.

FIGS. 31-36 show systems according to the present invention that have an item combined with a flashlight according to the present invention. Any flashlight or flashlights shown in or described for the systems shown in FIGS. 31-36 may be any flashlight disclosed and/or shown herein according to the present invention and, in certain non-limiting aspects, any such flashlight may be a flashlight according to the present invention with an emitter therein or thereon.

Figure 31:
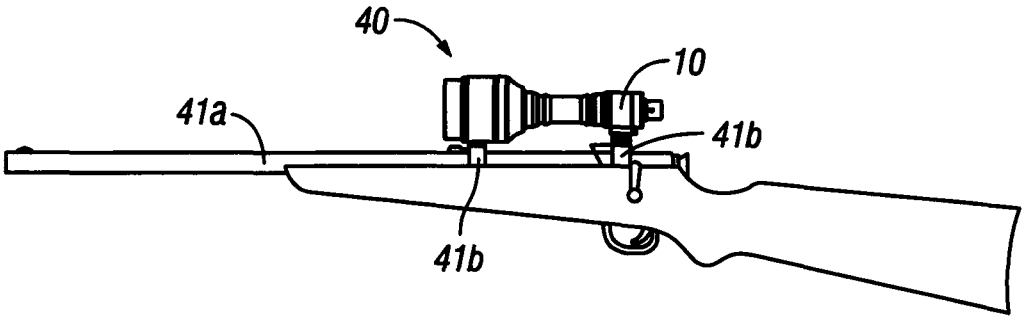
FIG. 31 is a side view of a system according to the present invention that includes a rifle, a flashlight mount, and a flashlight according to the present invention.

FIG. 31 depicts a system 40 according to the present invention that includes a rifle 41*a*, a flashlight mount with mount structures 41*b*, and a flashlight 10 according to the present invention secured to the rifle 41*a* with the mounts 41*b*.

Figure 32:
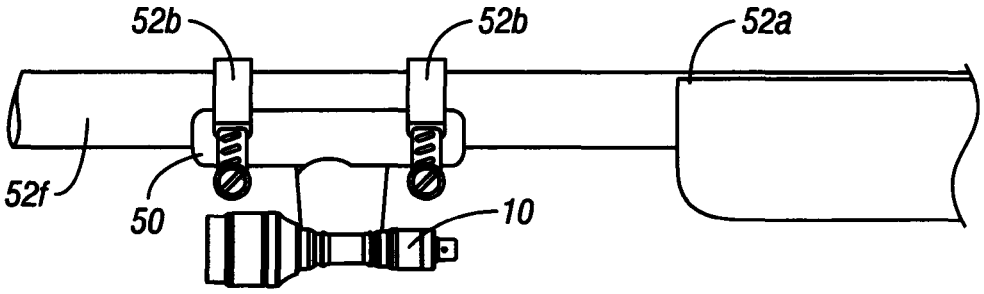
FIG. 32 is a side view of a system according to the present invention that includes a shotgun (shown partially), a flashlight mount, and a flashlight according to the present invention.

FIG. 32 shows a system 50 according to the present invention that includes a shotgun 52*a* (shown partially), and mounts 52*b* with which a flashlight 10 is secured to a barrel 54*f* of the shotgun 52*a*.

Figure 33:
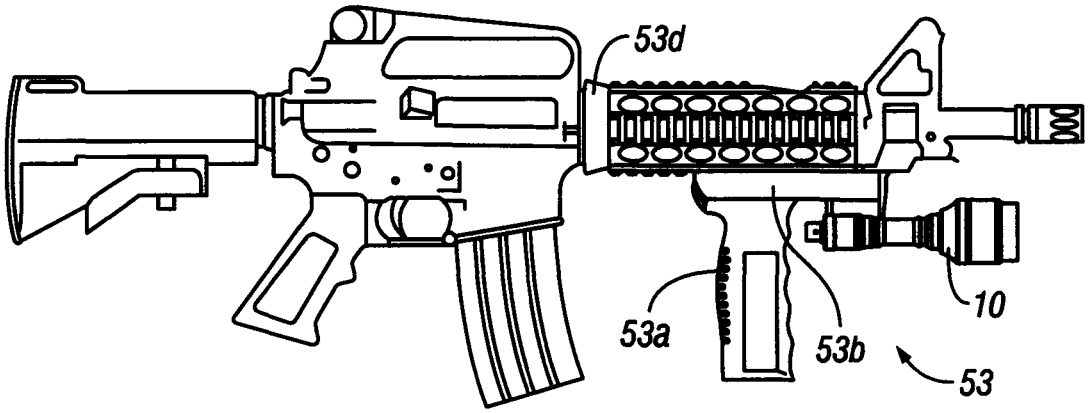
FIG. 33 is a side view of a system according to the present invention that includes a rifle, a flashlight mount, and a flashlight system according to the present invention.

FIG. 33 illustrates a system 53 according to the present invention that includes a rifle 53*d*, a flashlight mount 53*b* secured to the rifle 53*d*, the mount 53*b* having a handle 53*a*. A flashlight 10 according to the present invention is secured to the mount 53*b*.

Figure 34:
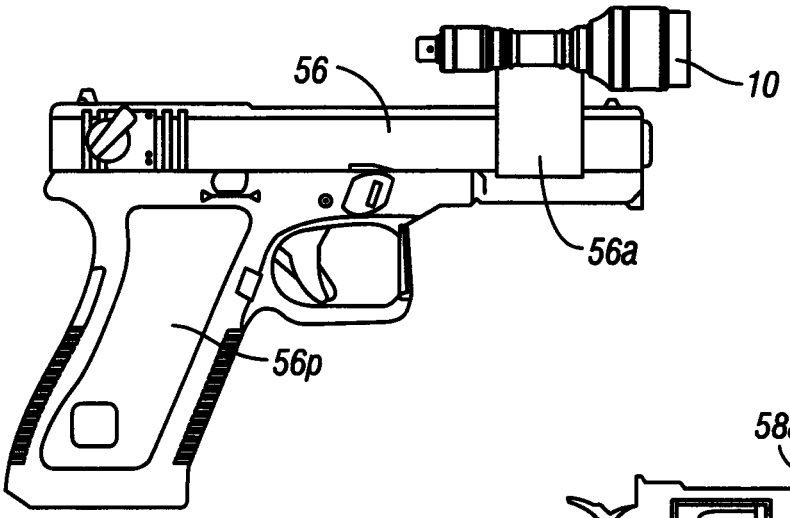
FIG. 34 is a side view of a system according to the present invention that includes an automatic pistol, a flashlight mount, and a flashlight according to the present invention.

FIG. 34 shows a system 56 according to the present invention that includes a pistol 56*p*, a flashlight mount 56*a*, and a flashlight 10 according to the present invention mounted above pistol 56*p* barrel via the flashlight mount 56*a*.

Figure 35:
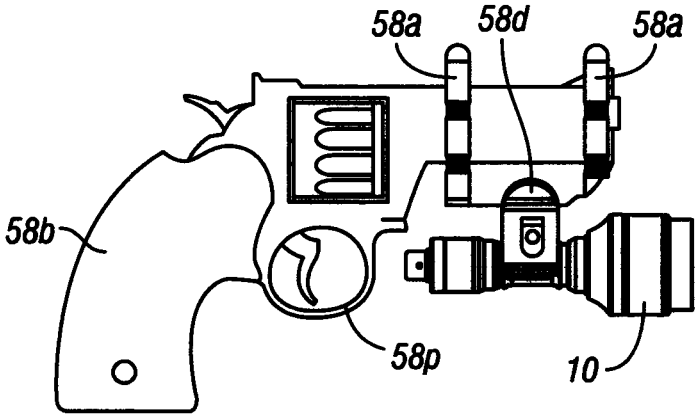
FIG. 35 is a side view of a system according to the present invention that includes a revolver, a flashlight mount, and a flashlight according to the present invention.

FIG. 35 depicts a system 58*b* according to the present invention that includes pistol 58*p*, flashlight mount 58*d*, and a flashlight 10 according to the present invention mounted below the pistol 58*p* barrel with the flashlight mount 58*d* and attachment(s) 58*a*.

Figure 36:
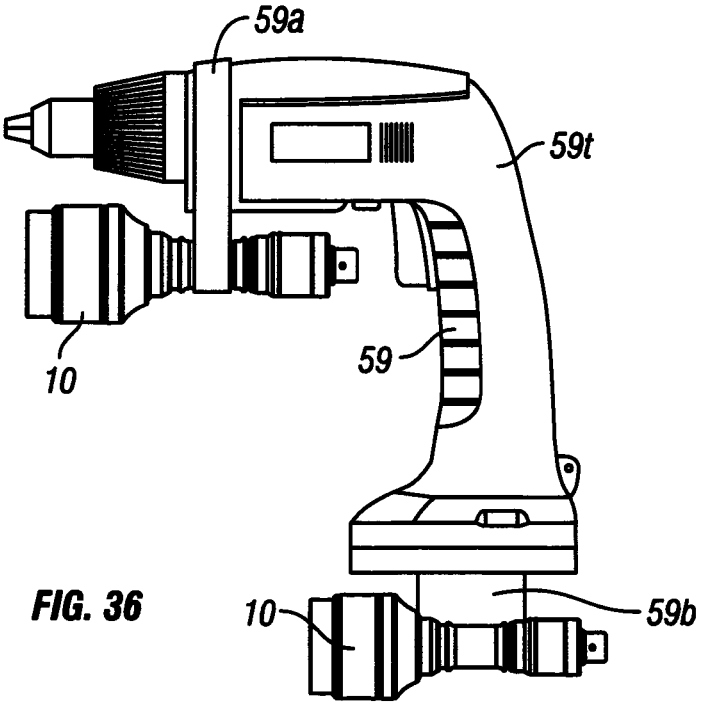
FIG. 36 is a perspective view of a system according to the present invention that includes a power tool, a flashlight mount, a flashlight strap, and optionally two flashlights according to the present invention.

FIG. 36 illustrates a system 59 according to the present invention that includes a power tool 59*t*, to part of which is strapped a flashlight 10, inferior to the drill bit, according to the present invention with a strap 59*a*. Optionally, the system 59 includes a flashlight 10 according to the present invention secured to the power tool 59*t* with a securement 59*b*, inferior to the base.

It is within the scope of the present invention to provide a system that includes a firearm (e.g, but not limited to, a gun, pistol, rifle, shotgun, wheel gun, derringer, revolver and/or optionally automatic or semiautomatic handguns and rifles) which has associated therewith a scope in addition to a flashlight according to the present invention. It is within the scope of the present invention for any such firearm to have a flashlight (or flashlights) mounted above a scope or below a scope, with any desired distance between the scope and the flashlight and/or with any desired distance between the flashlight and the firearm body, stock, or barrel. Also, a flashlight or flashlights in such systems may be mounted on the side of any firearm and at any desired angle to a horizontal line through part of the firearm or through the barrel.

Figure 37:
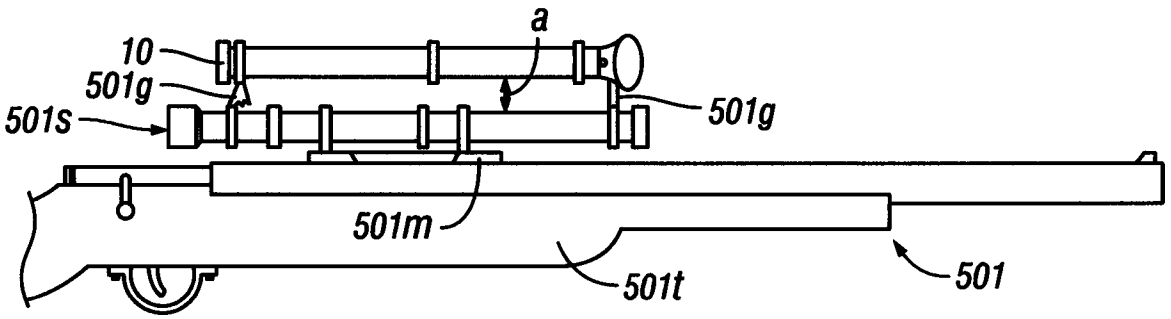
FIG. 37 is a side view of a system according to the present invention that includes a rifle (partially shown), a rifle scope between a superior flashlight and flashlight mount and inferior rifle according to the present invention.

FIG. 37 shows a system 501 according to the present invention that includes a rifle 501*t*, a scope 501*s* secured by a mount 501*m* to the rifle 501*t*, flashlight mounts 501*g* secured to the scope 501*s*, and a flashlight 10 according to the present invention secured to the scope 501*s* using the mounts 501*g* wherein flashlight 10 is superior to scope 501*s* which is superior to rifle 501*t*. The space "a" between a bottom surface of the flashlight 10 and the top surface of the scope 501*s* may be any desired distance, for example 0.3 inch, 0.5 inch, 0.75 inch, 1.0 inch, 1.2 inch, 1.4 inch, 1.5 inch, 2.0 inches, 2.3 inches, 2.5 inches, 2.7 inches or 3.0 inches.

Figure 38:
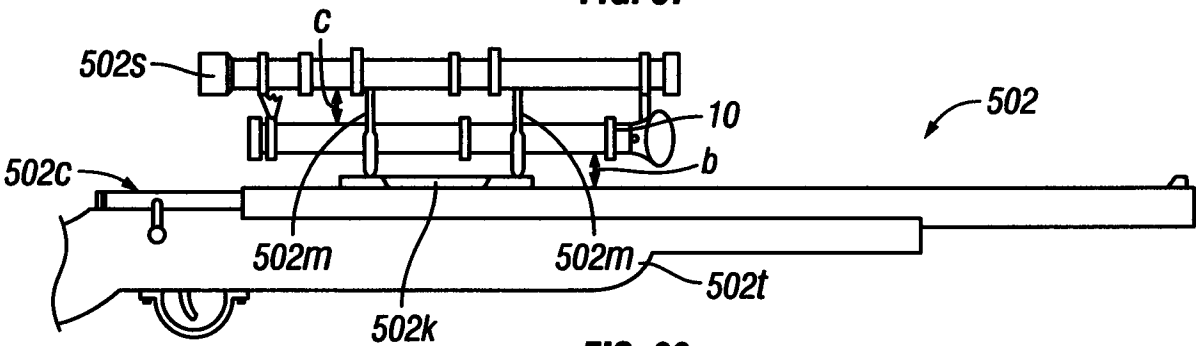
FIG. 38 is a side view of a system according to the present invention that includes a rifle (shown partially) and flashlight mount and flashlight between a rifle scope and rifle according to the present invention.

FIG. 38 shows a system 502 according to the present invention that includes a rifle 502*t*, a flashlight 10 according to the present invention secured to the rifle 502*t* with a mount 502*k*, and a scope 502*s* secured with mounts 502*m* to the flashlight 10 wherein flashlight 10 is inferior to scope 502*s* but superior to rifle 502*t*. A space "b" between a bottom surface of the flashlight 10 and a the top surface of the rifle 502*t* may be any desired distance for example 0.3 inch, 0.5 inch, 0.75 inch, 1.0 inch, 1.2 inch, 1.4 inch, 1.5 inch, 2.0 inches, 2.3 inches, 2.5 inch, 2.7 inches, and 3.0 inches and a space "c" between a bottom surface of the scope 503*s* and a top surface of the flashlight 10 wherein the top surface of the rifle 502*t* may be any desired distance for example 0.3 inch, 0.5 inch, 0.75 inch, 1.0 inch, 1.2 inch, 1.4 inch, 1.5 inch, 2.0 inches, 2.3 inches, 2.5 inches, 2.7 inches or 3.0 inches.

Figure 39:
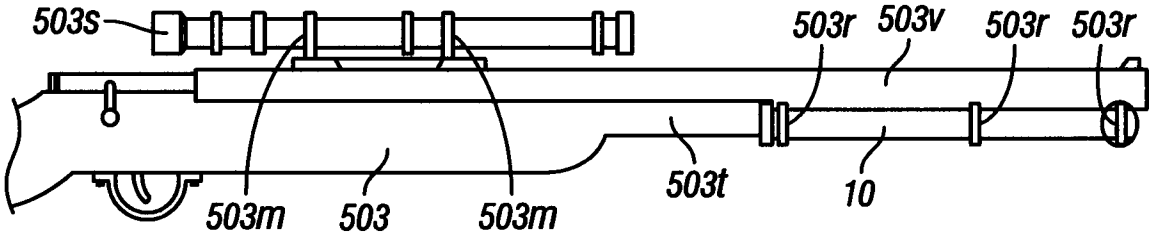
FIG. 39 is a side view of a system according to the present invention that includes a rifle (partially shown), a flashlight mount and a flashlight system inferior to a rifle barrel and a rifle scope superior to a rifle according to the present invention.

FIG. 39 shows a system 503 according to the present invention that includes a rifle 503*t*, a flashlight 10 according to the present invention secured underneath barrel 503*v* with mounts 503*r* and a scope 503*s* secured atop of the rifle with mounts 503*m* to the rifle 503*t*.

Figure 40:
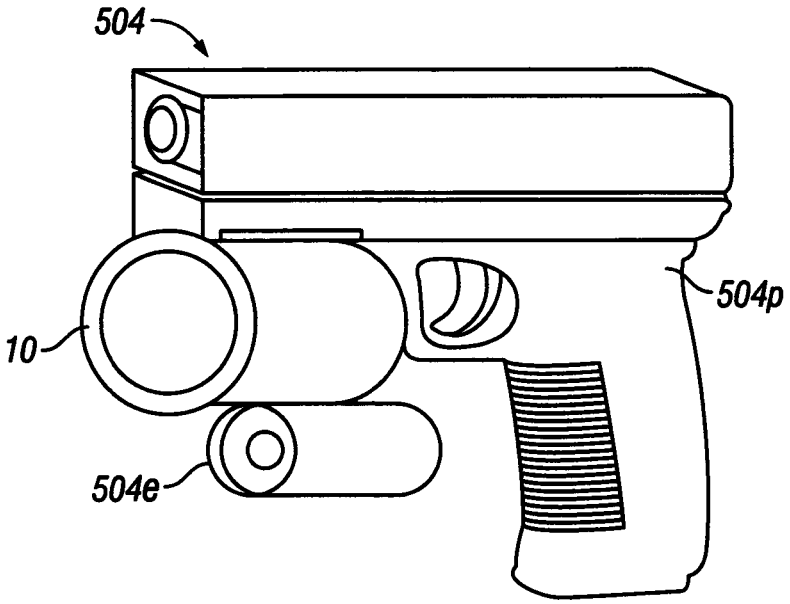
FIG. 40 is a side view of a system according to the present invention that includes a pistol, a flashlight mount, and a flashlight according to the present invention together with an emitter.

FIG. 40 shows a system 504 according to the present invention that includes a pistol 504*p*, a flashlight 10 according to the present invention mounted to pistol 504*p* together with an emitter 504*e* inferior to flashlight 10. It is within the scope of this invention to mount the emitter 504*e* to any part of the pistol, including, but not limited to, the top of the barrel, the handle, the side or rear of the handle, within the handle, or about or within flashlight 10.

The emitter 504*e* may be any emitter disclosed herein and may be, in certain but not all aspects, and without limitation, an emitter 504*e* for emitting olfactory nullifying material or ozone. As is true for any flashlight herein, it is within the scope of this invention to mount the flashlight to any part of the pistol (or to any part of any gun or other item shown herein), including, but not limited to, the top of a barrel, a handle, a rear or side of a handle, within a handle or to an emitter.

Figure 41:
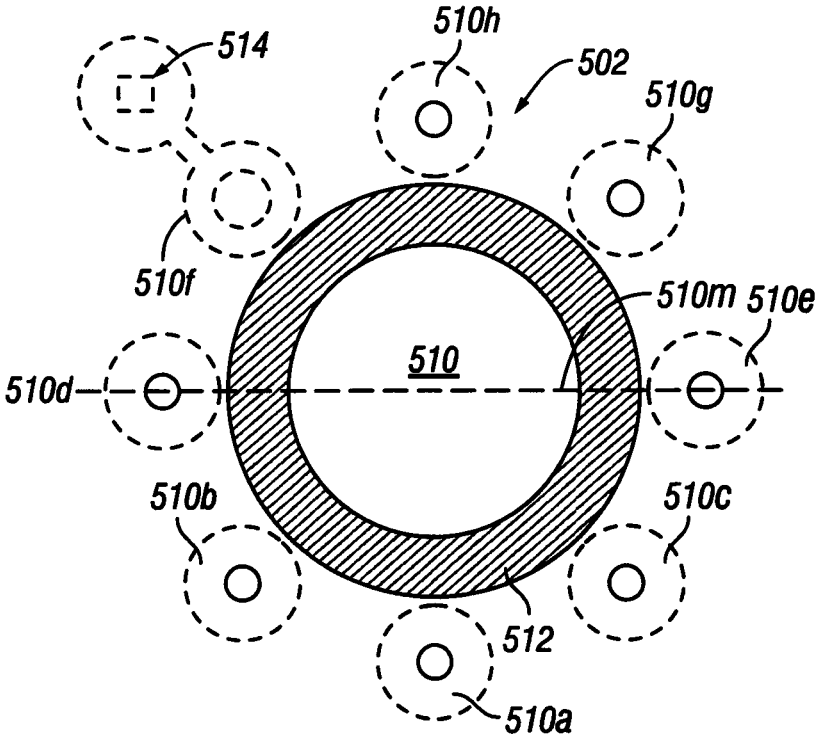
FIG. 41 is an exemplary representation of the present invention that includes various flashlight and emitter positions according to the present invention.

FIG. 41 shows a cross-sectional view of a system 502 which includes any gun according to the present disclosure, which has a barrel 512 with a bore 510 therethrough. A flashlight 10 according to the present invention may be secured about the barrel 512 at position 510*a*-510*h*, circumferentially. Further, flashlight 10 may be directly adjacent to barrel 512 or at a point further away (depicted where position 514 could be a flashlight 10 or a 510*f* 514 emitter-flashlight combination). If barrel 510 were a clock face, 510*h* would correlate to 12 o'clock, 510*a* would correlate to 6 o'clock, 510*d* would represent 9 o'clock and 510*e* would represent 3 o'clock. 510*b* would be interposed between 510*a* and 510*d*, 510*c* would be interposed between 510*a* and 510*e*. 510*f* would reside between 510*d* and 510*h* and 510*g* would reside between 510*e* and 510*h*.

It is within the scope of the present invention to secure a flashlight according to the present invention at any desired angle to an imaginary horizontal line 510*m*. Thus, each of the flashlights 10 according to the present invention illustrates flashlights at various positions and angles circumferentially about barrel 512. Additionally, it is within the scope of inventors to connect or attach an emitter 514 to flashlight 10 (as shown as flashlight 5100 whereby emitter 514 can be exterior to flashlight 510*f* (as depicted), internal to flashlight 510*f* (not shown) or at any reciprocating position 510*a*-510*h* without departing from the scope of the invention.

Instead of mounting a flashlight according to the present invention to a barrel of a gun, it can be mounted to any suitable part of any gun, or to any suitable part of any item to which it is desired to mount a flashlight. In one particular aspect, the barrel 512 may be replaced with a part of a stock or handle of a rifle, shotgun, or pistol and a flashlight or flashlights may be at any desired angle as shown in FIG. 41.

It is within the scope of the present invention to provide a scope for use with a flashlight according to the present invention, including, but not limited to, in leu of or in addition to any flashlight or emitter shown or described for the system of FIG. 41. Also, any flashlight and/or emitter may be at any desired angle to any scope shown and/or described herein separated or in conjunction thereto.

Figure 42:
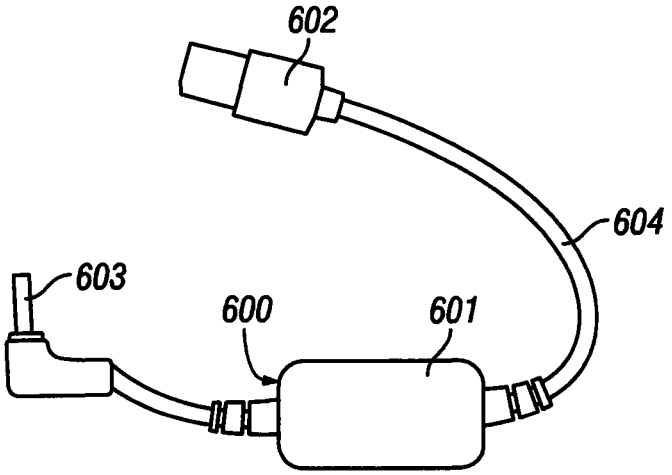
FIG. 42 shows a known system with a cable for charging a battery of the flashlight of FIG. 1 and charging of other flashlights according to the present invention.

FIG. 42 shows a control device 600 for use with a flashlight according to the present invention that can provide a touch controller 601 offering the various functions and modes which can be affected by using the tail cap switch 30 wherein control device 600 may be used in the alternative or in combination with tail cap switch 30. In certain aspects, it is convenient to use a control device 600 with a flashlight that is connected to or secured to another item such as, but not limited to, a rifle or other gun. Optionally the control device 600 itself includes charging capabilities to charge peripherals (i.e. flashlight battery 70) via 602 (e.g. via a Universal Serial Bus and ported access) cable 604 and male connector 603, in series, for insertion into charging cap 89. Moreover, the device 600 and its associated cables may be used to interface between flashlight 10 and a control device, computer or mobile application whereby control device 600 may both send information and receive feedback and diagnostic data.

It is within the scope of the present invention to provide headgear according to the present invention that includes an item worn on, over, or around the head and a flashlight or flashlights according to the present invention connected to, secured to, releasably adhered to, or attached to the headgear, for example, but not limited to a top, edge, side, bill or rear of a headgear.

Figure 43:
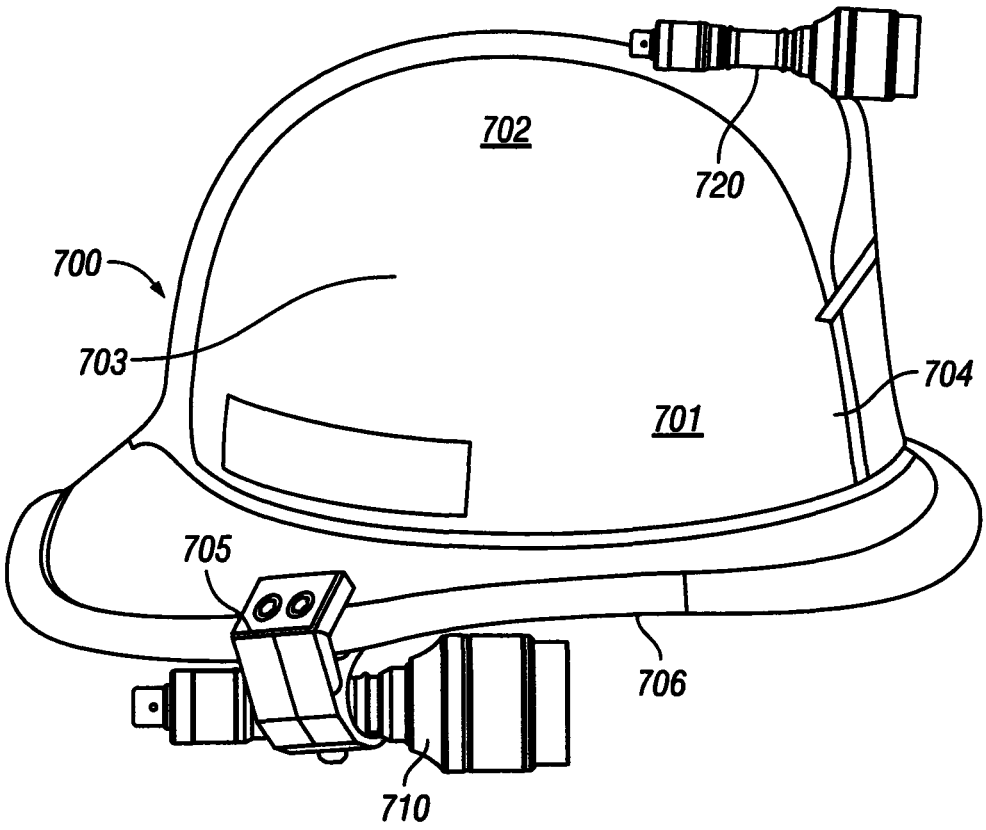
FIG. 43 shows headgear with a flashlight or flashlights mounted thereon according to the present invention.
Figure 44:
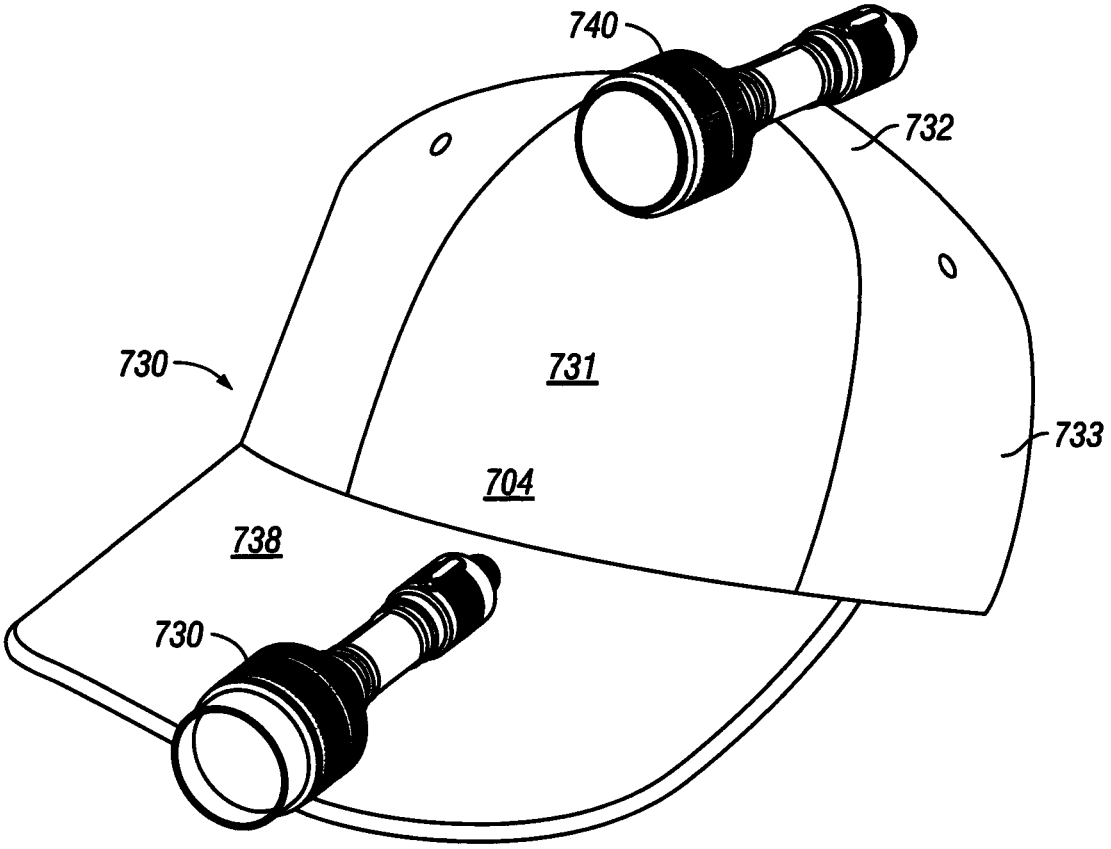
FIG. 44 depicts headgear with a flashlight or flashlights mounted thereon according to the present invention.

FIGS. 43 and 44 show headgear with flashlight(s) 10 according to the present invention. Any single one of any of these flashlights may be deleted, duplicated and found individually or in combination.

FIG. 43 shows a helmet 700 according to the present invention with a body 701, a top 702, sides 703 (one shown), a front 704, a mount 705 secured to any edge 706, and a flashlight 710 according to the present invention secured at the edge 706 with the mount 705. A flashlight 720 according to the present invention may additionally be connected to the top 702 of the helmet 700.

FIG. 44 shows a baseball cap 730 according to the present invention with a body 731, a top 732, sides 733 (one shown), a front 704, a bill 738, and a flashlight 730 according to the present invention secured to the bill 738 by any suitable means, structure, connection, or adhering material. A flashlight 740 according to the present invention may be additionally connected to the top 732 of the baseball cap 730. Optionally, not shown, a flashlight according to the present invention may be connected to a side 733 of the cap 730.

As can be easily understood from the foregoing, the basic concepts of the present invention may be embodied in a variety of ways. It involves both structures, apparatuses, equipment, method steps, and techniques as well as devices to accomplish the appropriate functions. Techniques and method steps according to the present invention are disclosed as part of the results shown to be achieved by the various devices and structures and described as steps which are inherent to utilization that are simply the natural result of utilizing the devices and structures as intended and described.

In addition, while some devices and structures are disclosed, it should be understood that these not only accomplish certain methods but also can be varied in a number of ways. Importantly, as to all of the foregoing, all of these facets should be understood to be encompassed by this disclosure.

The discussion herein is intended to serve as a basic description which may not explicitly describe all embodiments possible where many alternatives are implicit. Where the invention is described in device-oriented or apparatus-oriented terminology, each element of the device or apparatus implicitly performs a function. Neither the description nor the terminology herewith is intended to limit the scope of the claims that will be included in any subsequent, child, or offspring patent application.

Each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these.

Any claims set forth at any time during the pendency of the application for this patent or offspring of it are hereby incorporated by reference as part of this description of the invention, and the applicant expressly reserves the right to use all of or a portion of such incorporated content of such claims as additional description to support any of or all of the claims or any element or component thereof, and the right is expressly reserved to move any portion of or all of the incorporated content of such claims or any element or component thereof from the description into the claims or vice-versa as necessary to define the matter for which protection is sought by this application or by any subsequent application.

In conclusion, therefore, it is seen that the present invention and the embodiments disclosed herein and those covered by the appended claims are well adapted to carry out the objectives and obtain the ends set forth.

What is claimed is:

1. A flashlight comprising:
- a front end;
- said front end exhibiting a lens;
- a cylindrical body;
- said cylindrical body containing an internally, centrally deposed power source;
- a rear end;
- said front end, cylindrical body and rear end positioned sequentially in alignment, sharing a centrally running axis;
- a moveable member in the form of a cam follower;
- said cam follower operable to translocate between said lens and said power source, linearly, and perpendicular to said centrally running axis;
- a plurality of light sources within said cam follower's body, selectively movable for selection of one of said plurality of light sources;
- said selected one light source of said plurality of light sources displayed centrally and axially;
- a cam follower urging member; and
- a rotationally operable cam ring adjustable for movement and positioning of said cam follower whereby rotation of said cam ring allows for advancement and retraction of said cam follower in contact with individual, multi-level interior cam surface indentions, in opposition to said cam follower urging member, for selection of one of said plurality of light sources.

2. The flashlight of claim 1, wherein said moveable member translocation is opposed by a releasable urging member wherein said releasably urging member is a spring made to promote said cam follower advancement and oppose cam follower retraction.

3. The flashlight of claim 2, wherein said rotationally operable cam ring comprises a multi-level, inner keyed surfaces adjusted to various heights, internally;
- each said interior cam ring surface exhibiting indentions corresponding to one of said plurality of light sources;
- said rotationally operable cam ring being rotatable about said cam follower wherein said cam follower is moveable with respect to and in contact with said cam ring wherein cam ring rotation and resultant cam follower movement allows for selection of one of each said plurality light sources; and wherein said cam ring is rotationally operable to oppose said releasably urging spring at varying interior cam ring surface heights during rotation to facilitate movement of the cam follower into contact with one of next adjacent individual cam surfaces for selection of one of another of said plurality of light sources.

4. The flashlight of claim 3 wherein said cam follower has a cam follower tip which is indented and configured to seat a ball bearing to reduce friction and facilitate fluid transition of said cam follower tip along the inner surface of said rotationally operable cam ring during cam follower advancement to said interior cam ring surface indentions.

5. The flashlight of claim 1 wherein said rotatable cam ring is advanced either clockwise or counterclockwise to corresponding inner rotatable cam ring surface height indentions relating to one of the plurality of light sources displayed on said cam follower.

6. The flashlight of claim 1 wherein said light sources are light bulbs or Light Emitting Diodes (LEDs).

7. The flashlight of claim 1 wherein said light sources are light bulbs or Light Emitting Diodes (LEDs) exhibiting different colors of visible light.

8. The flashlight of claim 7 wherein the colors include red, white, green and/or blue.

9. The flashlight of claim 1 wherein said light sources are light bulbs or Light Emitting Diodes (LEDs) that may exhibit different light wavelengths including visible light, infrared light, UV light, and/or laser light.

10. The flashlight of claim 1 with any design, artwork, symbol, indicia, letter, numeral, part number, trademark, logo, or any other suitable desired marking(s), etched on, etched in, or embedded in or on a surface of a reflector, a surface of part of a body or housing, the surface being a surface behind a lens and/or a surface of a lens.

11. The flashlight of claim 1 wherein said rear end displays a tailcap further comprising:

an end push button for activating the flashlight, for selecting a desired mode of activation, for locking the flashlight to prevent its powering up, or of unlocking the flashlight, to permit it to be turned on, off and/or, optionally, rotatable for function selection and/or control of the intensity of the beam of the flashlight.

12. The flashlight of claim 1 wherein the flashlight has a lens for receiving and projecting light from one of a selected light source, a cam ring rotatable to induce advancement and retraction of a cam follower perpendicular to said light source to move one selected light source to another selected light source to the center of the flashlight for projection of light from the selected light source to a lens and into a field in front of said lens.

13. The flashlight of claim 1 wherein the lens is selectively rotatable to adjust a beam of light from said flashlight and/or to focus a beam of light from said flashlight from a narrow or narrower beam to a wide or wider beam and from a wide or wider beam to a narrow or narrower beam.

14. The flashlight of claim 1 wherein the cam ring includes internal keyed surface areas, a restricted path for movement within the keyed surface area and specific cam surface indentions for disposition in the keyed surface, the keyed surface having such an extent that the keyed portion can move along the keyed surface, but cannot move out of or beyond the keyed surface, thereby preventing the cam ring from moving beyond preselected limits corresponding to the extent of the keyed surface and where the keyed surface is of sufficient length that the cam follower can be moved to one of each selected cam surface indentions to select a desired light source.

15. The flashlight of claim 1 wherein each light source has a light source conductor structure for conducting power to all light sources or to each light source, individually, and power is conveyed from the power source, through a conductor structure to the light source or light sources.

16. The flashlight of claim 15 wherein the flashlight has power conveyed from a power source to a conductor structure, via a spring or springs, harboring an end ball or an end ball bearing rotatably operable and mounted to the spring, or rotatably connected to the conductor, the ball or ball bearing coming in contact with the light source conductor structure, so that as the movable member with the light sources thereon is moved during selection of a light source or selective activation of one light source, the ball or ball bearing moves adjacent to and in contact with the light source conductor, and power is conveyed to the light source(s) from the power source via the ball or ball bearing.

17. The flashlight of claim 16 wherein power is conveyed from a power source, through a first conducting spring and a circuit to a second conducting spring, located between the circuit and a conductor structure for light source illumination wherein, a conductive ball or ball bearing facilitates ease of movement from one conductor structure to the next thereby energizing said light source for flashlight beam production.

18. The flashlight of claim 1 wherein an item may be connected to, incorporated in or on, associated with, or included with the flashlight wherein the item may be one of bow, gun, rifle, pistol, cap, hat, helmet, hard hat, medical or veterinary instrument or device, surgical apparatus or instrument, support, and/or a vehicle.

19. The flashlight of claim 1 wherein said flashlight may be combined with an olfactory nullifying material dispenser or, in the case of a weapon, a scope.

20. The flashlight of claim 1 wherein an external port may be utilized to charge an internal battery, control said flashlight via external equipment or to provide for diagnostics.

21. A method of selecting one of a plurality of light sources within a flashlight comprising the steps of:

inserting within the front end of said flashlight, between a lens and a power source, internally, a linearly moveable member, in the form of a cam follower, running perpendicular to said flashlight's centrally deposed axis;

placing within the body of said moveable member a plurality of lens-facing, multi-colored light sources, sequentially;

placing a series of rearward and power-source facing conductors, within said moveable member, which are made to accept and transfer power to a corresponding light source, sequentially;

orienting said plurality of lens-facing, multi-colored light sources 180 degrees from said power-source facing conductors;

inserting at an internally deposed end of said cam follower an urgingly opposable member in the form of a spring;

inserting at the externally deposed tip of the cam follower a seated, movement facilitating ball bearing;

placing a cam ring, harboring various, multi-level internal heights, perpendicular to and circumferentially around said cam follower in direct communication with said ball bearing;

keying the internal surface of said cam ring wherein said cam follower is made to move with respect to and in contact with the cam ring in a dedicated path corresponding to exactly one of the plurality of lights;

rotating, clockwise and counterclockwise, said cam ring thus moving said cam follower linearly in said dedicated path wherein said movement is achieved by the advancement and resisting of retraction of said movable cam follower by the opposing forces of an inner keyed cam ring surface and said urgingly spring, to select an inner cam surface corresponding to one of the plurality light sources;

selecting one of a plurality of light sources to be positionable in the center of the flashlight for light projection on said lens;

providing a conduit for power supply from a battery, through a first spring, via a circuit, through a second spring and appended movement-facilitating conductive ball, for power provision to each selected light source;

conveying power from said power source and terminating in said light source; and causing flashlight light source illumination.

22. The method of claim 21 wherein the sources of light may be selectable by changing said light sources to include visible light sources of different colors of light and/or wherein the sources of light may include visible light, infrared light, UV light, and laser light.

23. The method of claim 21 wherein the width and intensity of a produced light beam may be adjusted by the additional steps of: creating a graded system allowing for retraction and extension of the lens in relation to the light source to allow for widening and narrowing of said beam, respectively.

24. The method of claim 21 wherein said cam ring includes an inner keyed surface having a keyed portion for linearly moveable member movement within the designated area and for disposition of the externally deposed tip of the cam follower within designated indentions within a portion of the keyed surface to such an extent that the externally deposed tip of the cam follower can move along the keyed surface, but cannot move out of or beyond the key surface, thereby preventing the cam ring from extending beyond its dedicated path.

* * * * *